US010794572B2

(12) United States Patent
Lim et al.

(10) Patent No.: US 10,794,572 B2
(45) Date of Patent: Oct. 6, 2020

(54) LED TROFFER FIXTURE HAVING A WIDE LENS

(71) Applicant: IDEAL Industries Lighting LLC, Durham, NC (US)

(72) Inventors: Jin Hong Lim, Durham, NC (US); Kurt Wilcox, Libertyville, IL (US); Mark Boomgaarden, Cary, NC (US); Randall Levy Bernard, Cary, NC (US); Curt Progl, Raleigh, NC (US)

(73) Assignee: Ideal Industries Lighting LLC, Sycamore, IL (US)

( * ) Notice: Subject to any disclaimer, the term of this patent is extended or adjusted under 35 U.S.C. 154(b) by 0 days.

(21) Appl. No.: 16/692,130

(22) Filed: Nov. 22, 2019

(65) Prior Publication Data

US 2020/0088387 A1 Mar. 19, 2020

Related U.S. Application Data

(63) Continuation of application No. 15/710,913, filed on Sep. 21, 2017, now Pat. No. 10,508,794.

(51) Int. Cl.

| | |
|---|---|
| ***F21V 15/01*** | (2006.01) |
| ***F21K 9/272*** | (2016.01) |
| ***F21V 21/03*** | (2006.01) |
| ***F21V 7/00*** | (2006.01) |
| ***F21V 5/04*** | (2006.01) |
| ***F21V 13/04*** | (2006.01) |

(Continued)

(52) U.S. Cl.

CPC ..... *F21V 15/01* (2013.01); *F21K 9/272* (2016.08); *F21V 5/04* (2013.01); *F21V 7/005* (2013.01); *F21V 7/0016* (2013.01); *F21V 7/0033* (2013.01); *F21V 7/0091* (2013.01); *F21V 13/04* (2013.01); *F21V 21/03* (2013.01); *F21Y 2113/13* (2016.08); *F21Y 2115/10* (2016.08)

(58) Field of Classification Search

CPC combination set(s) only.
See application file for complete search history.

(56) References Cited

U.S. PATENT DOCUMENTS 5,384,693 A * 1/1995 Schwaller ..... B60Q 1/2696 340/432
7,874,697 B2 * 1/2011 Biebel ..... F21V 29/505 362/225

(Continued)

OTHER PUBLICATIONS

U.S. Appl. No. 61/932,058, filed Jan. 27, 2014.
U.S. Appl. No. 62/292,528, filed Feb. 8, 2016.

*Primary Examiner* — Evan P Dzierzynski
(74) *Attorney, Agent, or Firm* — Myers Bigel, P.A.

(57) ABSTRACT

A troffer light fixture has a housing with a LED assembly positioned in the housing. The LED assembly includes at least one LED array comprising LEDs of at least two different colors. The LED assembly includes a first LED array having a first LED on a first string and a second LED on a second string and a second LED array having a third LED on a third string and fourth LED on a fourth string. A wide lens covers the LED array. A reflector assembly has a first reflective surface and a second reflective surface reflecting light from the at least one LED array laterally across the width of the wide lens. Alternatively, the LED array may be approximately one-half the width of the wide lens and the reflector may be eliminated.

20 Claims, 27 Drawing Sheets

(51) Int. Cl.
*F21Y 115/10* (2016.01)
*F21Y 113/13* (2016.01)

(56) References Cited

U.S. PATENT DOCUMENTS

| | | | | |
|---|---|---|---|---|
| 8,736,186 | B2 | 5/2014 | Chobot | |
| 8,829,821 | B2 | 9/2014 | Chobot et al. | |
| 8,912,735 | B2 | 12/2014 | Chobot et al. | |
| 8,975,827 | B2 | 3/2015 | Chobot et al. | |
| 9,155,165 | B2 | 10/2015 | Chobot | |
| 9,155,166 | B2 | 10/2015 | Chobot | |
| 9,433,061 | B2 | 8/2016 | Chobot | |
| 9,572,226 | B2 | 2/2017 | Motley et al. | |
| 9,622,321 | B2 | 4/2017 | Creasman et al. | |
| 9,786,639 | B2 | 10/2017 | Bergmann et al. | |
| 2008/0278943 | A1 | 11/2008 | Van Der Poel | |
| 2011/0222279 | A1 | 9/2011 | Kim et al. | |
| 2012/0299017 | A1* | 11/2012 | Chen | F21V 13/14 257/88 |
| 2013/0258245 | A1 | 10/2013 | Fang | |
| 2014/0268790 | A1 | 9/2014 | Chobot et al. | |
| 2014/0347885 | A1 | 11/2014 | Wilcox et al. | |
| 2016/0061413 | A1 | 3/2016 | Hedberg | |
| 2016/0305619 | A1* | 10/2016 | Howe | F21V 13/04 |
| 2018/0172246 | A1* | 6/2018 | Walker | F21V 15/015 |

* cited by examiner

LED TROFFER FIXTURE HAVING A WIDE LENS

RELATED APPLICATIONS

The present application is a continuation of U.S. patent application Ser. No. 15/710,913, filed Sep. 21, 2017, which is incorporated by reference herein in its entirety.

BACKGROUND OF THE INVENTION

The invention relates to lighting fixtures and, more particularly, to indirect, direct, and direct/indirect lighting troffers that are well-suited for use with solid state lighting sources, such as light emitting diodes (LEDs).

Troffer-style fixtures are ubiquitous in residential, commercial, office and industrial spaces throughout the world. In many instances the legacy troffer-style fixtures include troffer housings or pans that house elongated fluorescent light bulbs that span the length of the troffer. Troffer housings may be mounted to or suspended from ceilings. Often the troffer housing may be recessed into the ceiling, with the back side of the troffer housing protruding into the plenum area above the ceiling. Elements of the troffer housing on the back side may dissipate heat generated by the light source into the plenum where air can be circulated to facilitate the cooling mechanism.

More recently, with the advent of efficient solid state lighting sources, these troffer-style fixtures have been used with LEDs. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

SUMMARY OF THE INVENTION

In some embodiments a troffer-style light fixture comprises a housing with a LED assembly positioned in the housing. The LED assembly comprises a first LED array comprising a first LED on a first string and a second LED on a second string and a second LED array comprising a third LED on a third string and fourth LED on a fourth string. A lens covers the first LED array and the second LED array. A reflector assembly extends between the first LED array and the second LED array. The reflector assembly comprises a first reflective surface reflecting light from the first LED array and a second reflective surface reflecting light from the second LED array.

The LED assembly may comprise a LED board supporting a plurality of LEDs where the LED board is in the electrical path to the LEDs. The lens may have a width of at least approximately 250 mm. The lens may have a width of approximately 250 mm to 375 mm. The lens may be diffusive. The first LED array and the second LED array may each comprise three differently colored LEDs. The first LED array and the second LED array may each comprise three different colored LEDs ordered BSY1, BSR, BSY2, BSR, BSY1, BSR, BSY2 for the length of the array. The first reflective surface may be configured to reflect the light emitted by the first LED array laterally in a first direction and the second reflective surface may be configured to reflect the light emitted by the second LED array laterally in a second direction. The first reflective surface and the second reflective surface may have a parabolic shape. The first reflective surface and the second reflective surface may receive and reflect approximately 65-75% of the light emitted by the first LED array and the second LED array, and approximately 25-35% of the light emitted by the LEDs travels to the fixture lens without hitting the reflective surfaces. The first reflective surface and the second reflective surface may be symmetrical. The first reflective surface and the second reflective surface may have a splined shape. The first reflective surface and the second reflective surface may be symmetrical. A surface of the housing may be diffusive and may reflect at least a portion of the light emitted by the LED assembly. The first reflective surface and the second reflective surface may be asymmetrical. The first reflective surface and the second reflective surface may have specular reflective properties. The first reflective surface and the second reflective surface may have a combination of specular and diffuse reflective properties. A third LED array may comprise at least one LED of a first color and at least one LED of a second color, the third LED array being disposed between the first LED array and the second LED array. The light emitted by the third LED array may not be reflected before being received by the lens. The third LED array may produce lower lumen output than the first LED array and the second LED array.

In some embodiments, a troffer-style light fixture comprises a housing with an LED assembly positioned in the housing. The LED assembly comprises at least one LED array comprising at least one LED of a first color and at least one LED of a second color. A lens covers the first LED array and the second LED array. A reflector assembly extends along the at least one LED array and is positioned to receive light from the LED array. The reflector assembly may be located between LED assembly and fixture lens. The reflector assembly comprises a TIR reflector comprising a first reflective surface reflecting light from the at least one LED array in a first lateral direction and a second reflective surface reflecting light from the at least one LED array in a second lateral direction.

The lens may have a width of at least approximately 250 mm. The lens may have a width of approximately 250 mm to 375 mm and in some embodiments the lens may have a width of 336 mm. The at least one LED array may comprise three differently colored LEDs. The at least one LED array may comprise three different colored LEDs ordered BSY1, BSR, BSY2, BSR, BSY1, BSR, BSY2 and so on for the length of the array. The at least one LED array may comprise a first LED array and a second LED array. The first reflective surface may reflect the light emitted by the first LED array laterally in a first direction and the second reflective surface may reflect the light emitted by the second LED array laterally in a second direction. The first reflective surface and the second reflective surface may have a generally cylindrical shape with a profile of parabola or splined curves. The first reflective surface and the second reflective surface may reflect approximately 65-75% of the light emitted by the first LED array and the second LED array, and approximately 25-35% of the light emitted by the LEDs travels to fixture lens without hitting the reflective surfaces.

In some embodiments, a troffer light fixture comprises a housing, a lens, and a LED array. The lens may have a width of at least approximately 250 mm. A LED assembly is supported by the housing and comprises a LED board supporting an LED array that emits light that is transmitted through the lens. The LED array comprises at least one LED of a first color and at least one LED of a second color where the LED array is approximately one-half the width of the lens.

DETAILED DESCRIPTION OF EMBODIMENTS OF THE INVENTION

Figure 1:
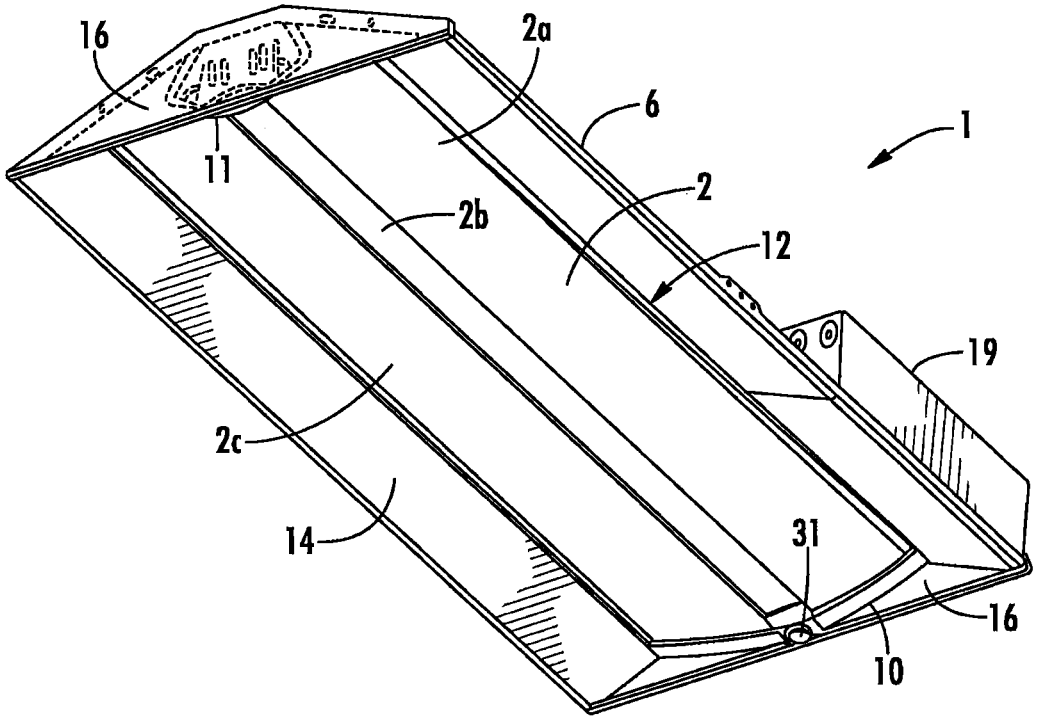
FIG. 1 is a perspective view of an embodiment of a troffer-style lighting fixture.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 3:
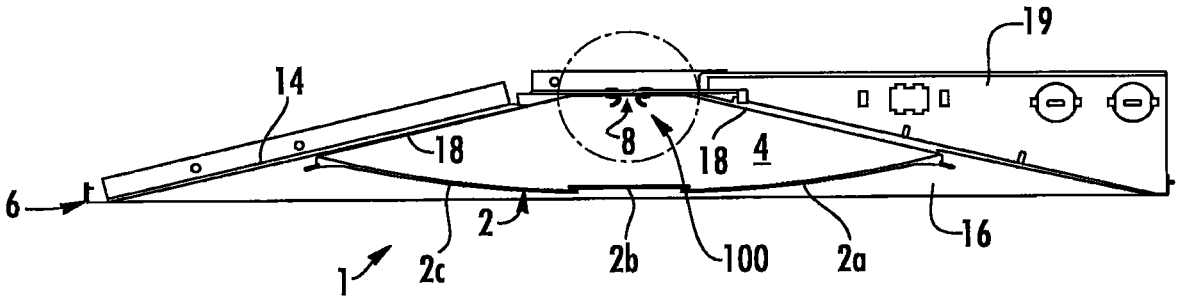
FIG. 3 is a section view taken along line 3-3 of FIG. 2.
Figure 2:
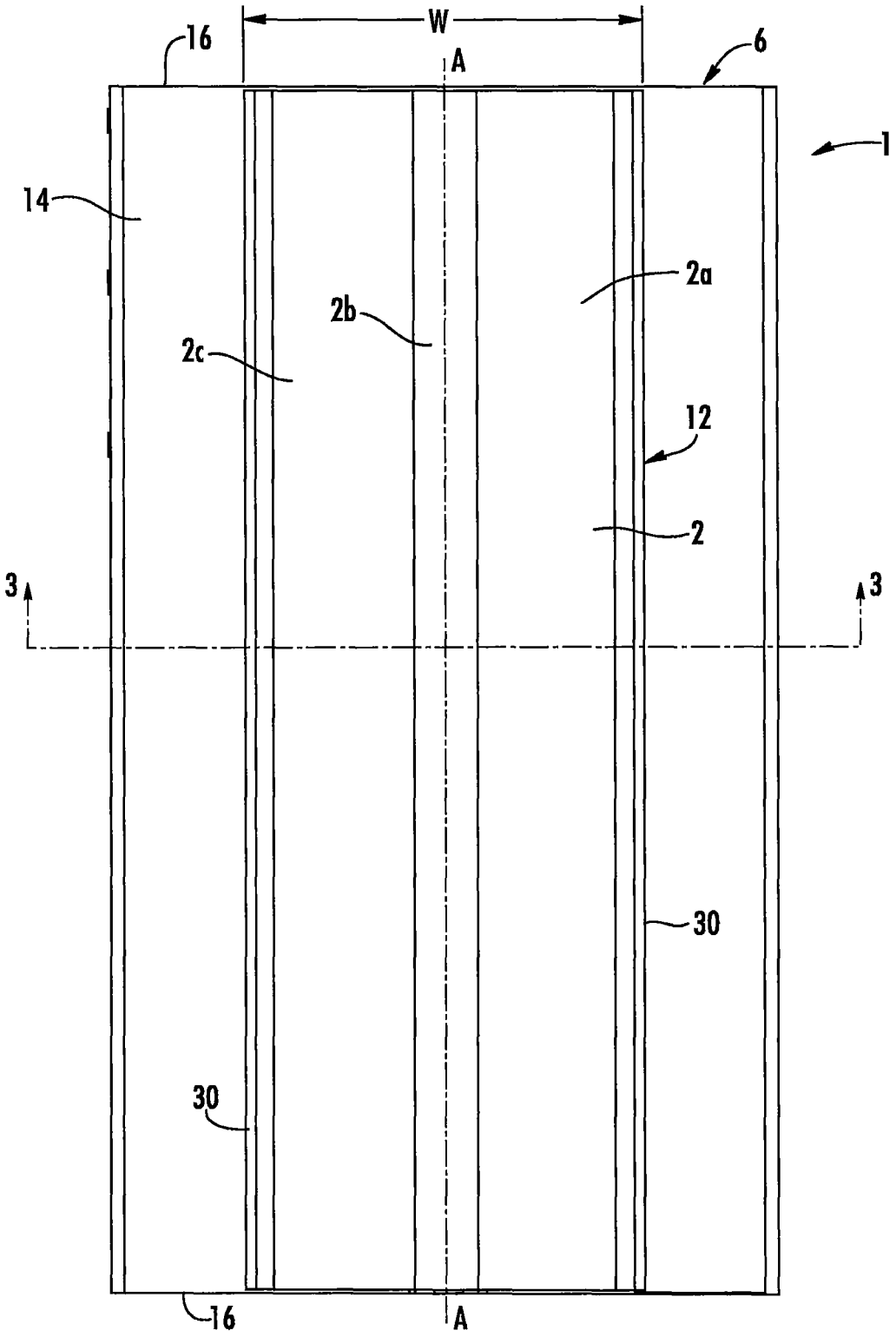
FIG. 2 is a plan view of the lighting fixture of FIG. 1.

Embodiments of the present invention provide a troffer-style light fixture that is particularly well-suited for use with solid state light sources, such as LEDs. Referring to FIGS. 1-4 an embodiment of a light fixture 1 comprises a troffer housing or pan 6 that may be removably attached within a T grid, ceiling grid or other suitable support structure. The light fixture 1 is shown in FIG. 1 in a typical orientation where the light is emitted in a generally downward direction; however, in use the light fixture may have other orientations. A lens 2 is mounted on the troffer housing 6 to create an interior space 4 (FIG. 3). The interior space 4 created by the lens 2 and troffer housing 6 contains LED assembly 8 and in some circumstances additional electronics. Lens 2 may form part of a lens assembly 12 that may also comprise end caps 10 and 11 that are disposed at either end of the lens 2 to close the interior space 4 and facilitate mounting of the lens 2 in troffer housing 6. The lens 2 may be mounted in the troffer housing 6 by any suitable mechanism and end caps 10 and 11 may be eliminated or incorporated into the troffer housing 6. The troffer housing 6 may also support lamp electronics in electronics housing 19 such as a driver, power supply, control circuitry for Smart Cast technology or the like.

The housing 6 may comprise a back panel 14 having an end panel 16 secured to each end thereof. The end panels 16 and back panel 14 form a recessed pan style troffer housing for receiving the LED assembly 8 and the lens 2. The end panels 16 and back panel 14 may be made of multiple sheet metal components secured together or the panels 14 and 16 and/or housing 6 may be made of a single piece of sheet metal formed into the desired shapes. In some embodiments, the back panel 14 may be multiple pieces. In some embodiments, the end panels 16 may be separately secured to the back panel 14 using a clinching joint. In other embodiments the connection between the end panels 16 and back panel 14 may be made by welding, screws, tabs and slots or the like.

The exposed surfaces of the back panel 14 and end panels 16 may be made, coated with or covered in a light diffusive material. The diffusive surfaces of the panels may comprise many different materials. The diffusive surfaces create a uniform, soft light source without unpleasant glare, color striping, or hot spots. The exposed surfaces of the housing may comprise a diffuse white reflector, such as a microcellular polyethylene terephthalate (MCPET) material or a DuPont/WhiteOptics material, for example. Other white diffuse reflective materials can also be used. The housing may also be aluminum with a diffuse white coating. Moreover, the exposed surfaces inside of space 4 may comprise or may be covered in a light diffusive material. In the illustrated embodiment the housing surfaces inside of space 4 are covered by white diffusive panels 18 that expose a white diffusive surface 18*a* in space 4. The diffusive surfaces of the panels 18 may comprise many different materials. The panels 18 may comprise a diffuse white reflector, such as a microcellular polyethylene terephthalate (MCPET) material or a DuPont/WhiteOptics material, for example. Other white diffuse reflective materials can also be used. The panels 18 may also be aluminum with a diffuse white coating. Moreover, the diffusive surfaces 18*a* may be formed as part of the troffer housing 6 rather than as separate panels. For example the surfaces of back panel 14 may be coated in a white diffusive coating or the back panel may be made of a white diffusive material.

The light fixture may be provided in many sizes, including standard troffer fixture sizes, such as 2 feet by 4 feet (2'×4') (shown in FIG. 1), 1 foot by 4 feet (1'×4') or 2 feet by 2 feet (2'×2'), for example. However, it is understood that the elements of the light fixture may have different dimensions. Furthermore, it is understood that embodiments of the fixture can be customized to fit most any desired fixture dimension. The light fixture 1 may be mounted within a T grid by being placed on the supports of the T grid. In other embodiments, additional attachments, such as tethers, may be included to stabilize the fixture in case of earthquakes or other disturbances. In other embodiments, the light fixture may be suspended by cables, recessed into a ceiling or mounted on another support structure.

The lens 2 may comprise a cylindrical lens. In some preferred embodiments the lens is diffusive. The lens may comprise an extruded frosted plastic material such as frosted acrylic. The lens 2 may be uniform or may have different features and diffusion levels. In some embodiments, a portion of the lens may be more diffuse than the remainder of the lens. The lens may include various sections 2*a*, 2*b* and 2*c* where the optical characteristics of the lens may vary across its width. For example, the various sections of the lens may be more or less diffusive than other sections and/or the various sections of the lens may have different shapes, surface finishes or the like. The lens 2 may be a one-piece member or it may be constructed of multiple pieces assembled to create the lens. In one embodiment the entire lens 2 is light transmissive and diffusive. In one embodiment the lens 2 may comprise an acrylic cylindrical lens where the lens is a segment of a hollow cylinder where the profile of the lens is generally formed on arc of a circular. The lateral sides of the lens 2 are defined by a pair of longitudinal edges 30. The longitudinal edges 30 extend for the length of the lens and extend generally parallel to the LED assembly 8.

The end caps 10, 11 may be provided in various dimensions and styles suitable for the aesthetics of the light fixture. The end caps 10, 11 may be formed of plastic and may be formed as one piece with the lens or as separate members. The ends of lens 2 may be press fit into mating slots 7 in the end caps and/or the end caps may be connected to the lens by separate clips, fasteners, tabs and slots, snap-fit connectors or the like. A first mounting structure 9 on the end caps 10, 11 may releasably engage mating second mounting structures formed on the housing 6 such that the lens assembly 12 is removable from the housing. One of the first and second mounting structures may deformably engage the other one of the first and second mounting structures to releasably retain the lens assembly in the housing. Other mechanisms for mounting the lens in the housing may also be used The lens 2 comprises a wide-fixture lens. A wide fixture lens may be defined as a lens that has a lateral width W of at least approximately 250 mm and in some embodiments may be between approximately 250 mm and 375 mm and may be approximately 336-338 mm. A wide-fixture lens has a lateral width that is much larger than a typical lens in an LED troffer-style fixture which may typically have a width of approximately 137 mm. The lateral width W is disposed perpendicularly to the longitudinal axis A-A of the lens where the LEDs are disposed along or parallel to the longitudinal axis. Linearly arrayed LEDs such as arranged in a troffer-style LED fixture emit a Gaussian type of light distribution with a sharp peak luminance in the center. As a result, a linearly arranged LED array if used with a wide-fixture lens would create a bright spot along the longitudinal center of the lens with dimmer lateral sides. Also, typically multiple types of LEDs are used in combination to increase CRI and LPW and to provide good color mixing to meet standard Color Angular Uniformity. With a wide-fixture lens color mixing may be inadequate. As a result, with a wide-fixture lens it is difficult to provide fully distributed luminance and good color mixing on the lens surface. The lighting fixture of the invention overcomes these issues in a wide-fixture lens.

A driver circuit or multiple driver circuits 130, 132 (FIG. 16) may be housed within a compartment 19. Electronic components within the compartment 19 may be shielded and isolated. Various driver circuits may be used to power the light sources. Suitable circuits are compact enough to fit within the compartments, while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter, both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment. Some of the electronic circuitry for powering the LEDs 22 such as the driver and power supply and other control circuitry may be contained as part of the LED assembly 8 or the lamp electronics may be supported separately from the LED assembly such as in housing 19 as shown in FIG. 1.

The LED assembly 8 comprises a LED board 20 with light emitters such as LEDs 22. The LED board 20 may be any appropriate board, such as a PCB, flexible circuit board or metal core circuit board with the LEDs 22 mounted and interconnected thereon. Moreover the LED board 20 may comprise multiple components such as a flexible circuit mounted on a rigid submount. The LED board 20 can include the electronics and interconnections necessary to power the LEDs 22. Details of suitable arrangements of the LEDs and lamp electronics for use in the light fixture 1 are disclosed in U.S. patent application Ser. No. 15/226,992, entitled "Solid State Light Fixtures Suitable for High Temperature Operation Having Separate Blue-Shifted-Yellow/Green and Blue-Shifted-Red Emitters" filed on Aug. 3, 2016 which is incorporated by reference herein in its entirety. In other embodiments, all similarly colored LEDs may be used where for example all warm white LEDs or all warm white LEDs may be used where all of the LEDs emit at a similar color point. In such an embodiment all of the LEDs are intended to emit at a similar targeted wavelength; however, in practice there may be some variation in the emitted color of each of the LEDs such that the LEDs may be selected such that light emitted by the LEDs is balanced such that the lamp emits light at the desired color point. In the embodiments disclosed herein a various combinations of LEDs of similar and different colors may be selected to achieve a desired color point.

Figure 11:
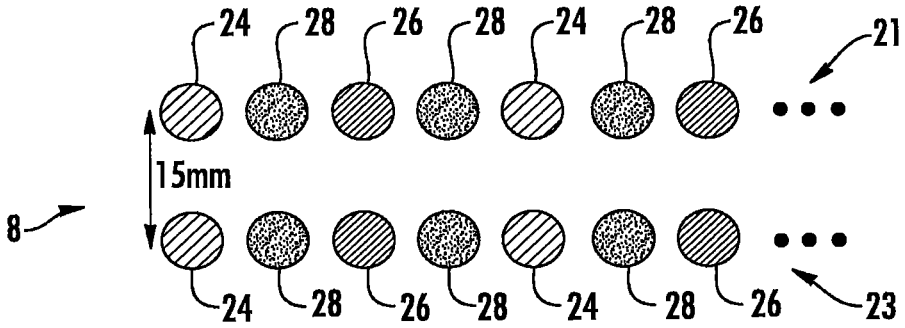
FIG. 11 is a view showing the arrangement of the LEDs.

Referring to FIG. 11, in one embodiment the LED assembly 8 comprises three differently colored LEDs comprising BSY1 LEDs 24, BSY2 LEDs 26 and BSR LEDs 28. Two linear LED arrays 21, 23 each comprising a linear row of LEDs are used where each row has a layout of the three different colored LEDs to provide good color mixing. The sequence of the three different colored LEDs in each row are laid out as follows: The BSY1 LEDs 24 and BSY2 LEDs 26 are neighbored around the BSR LEDs 28 along each linear array and the BSY1 and the BSY2 are switched sequentially such that each linear array is ordered BSY1, BSR, BSY2, BSR, BSY1, BSR, BSY2 and so on for the length of the array. It is to be understood that each linear array may start with anyone of the three differently colored LEDs and have the alternating pattern described above. The total number of LEDs determines the spacing of the LEDs and lumen output of the fixture, where proper spacing provides good color mixing and/or good pixilation. In one embodiment, the LED count is 160 with a spacing of less than 12.0 mm between the two rows of the LED array for a 2'×2' fixture and in one embodiment the spacing is approximately 7.26 mm.

Figure 4:
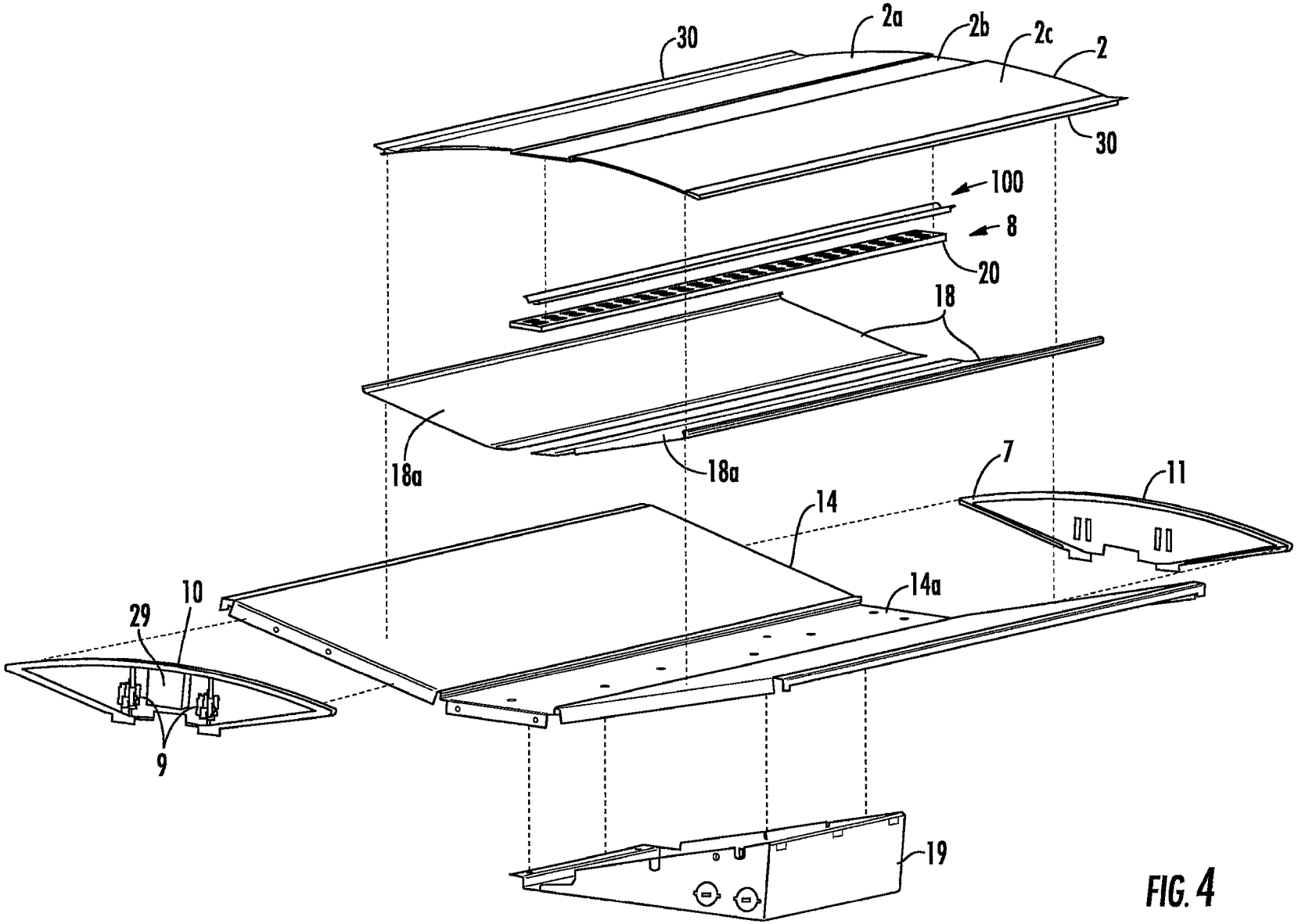
FIG. 4 is an exploded perspective view of the lighting fixture of FIG. 1.
Figure 5:
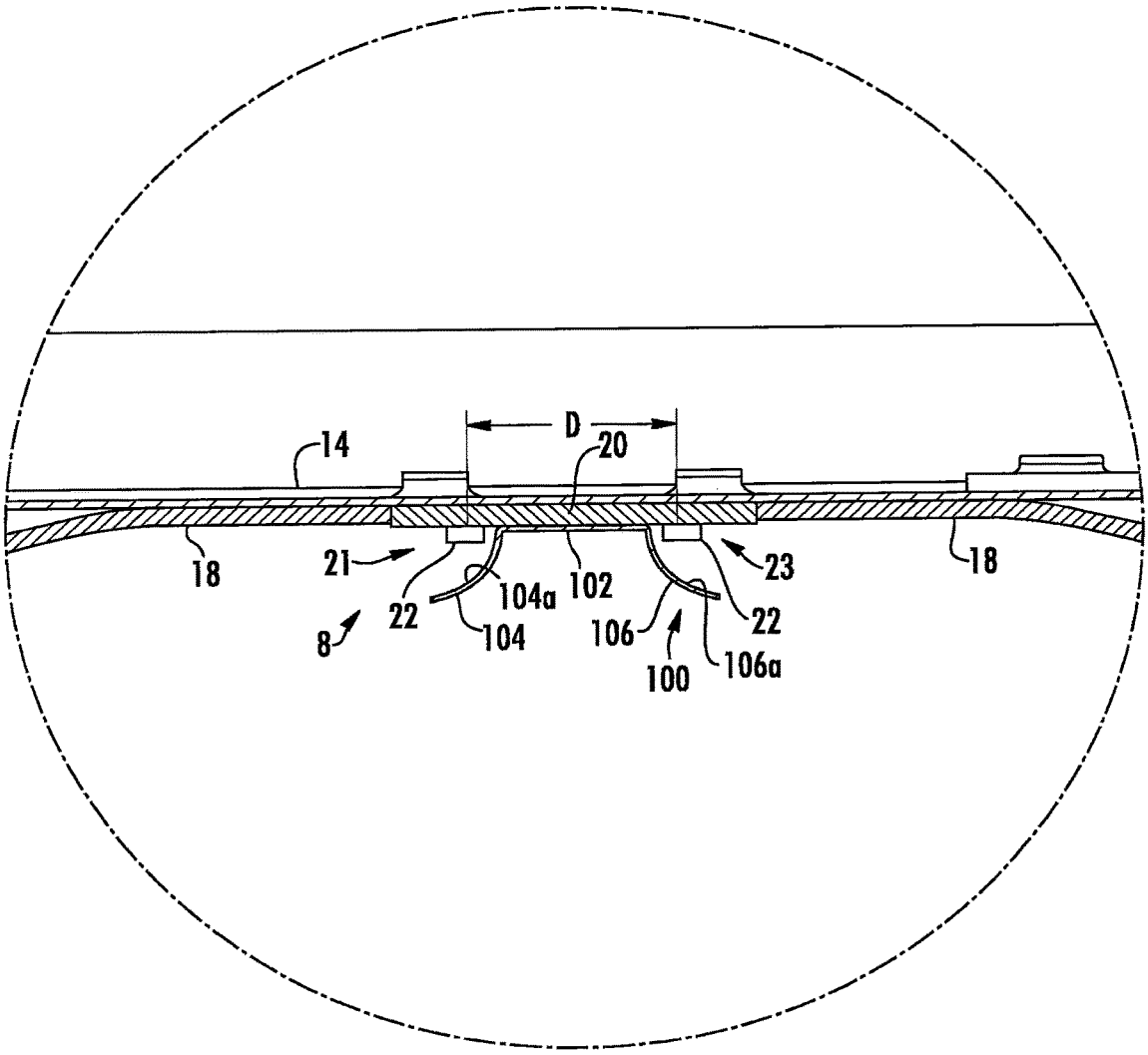
FIG. 5 is a detail view of FIG. 3.
Figure 6:
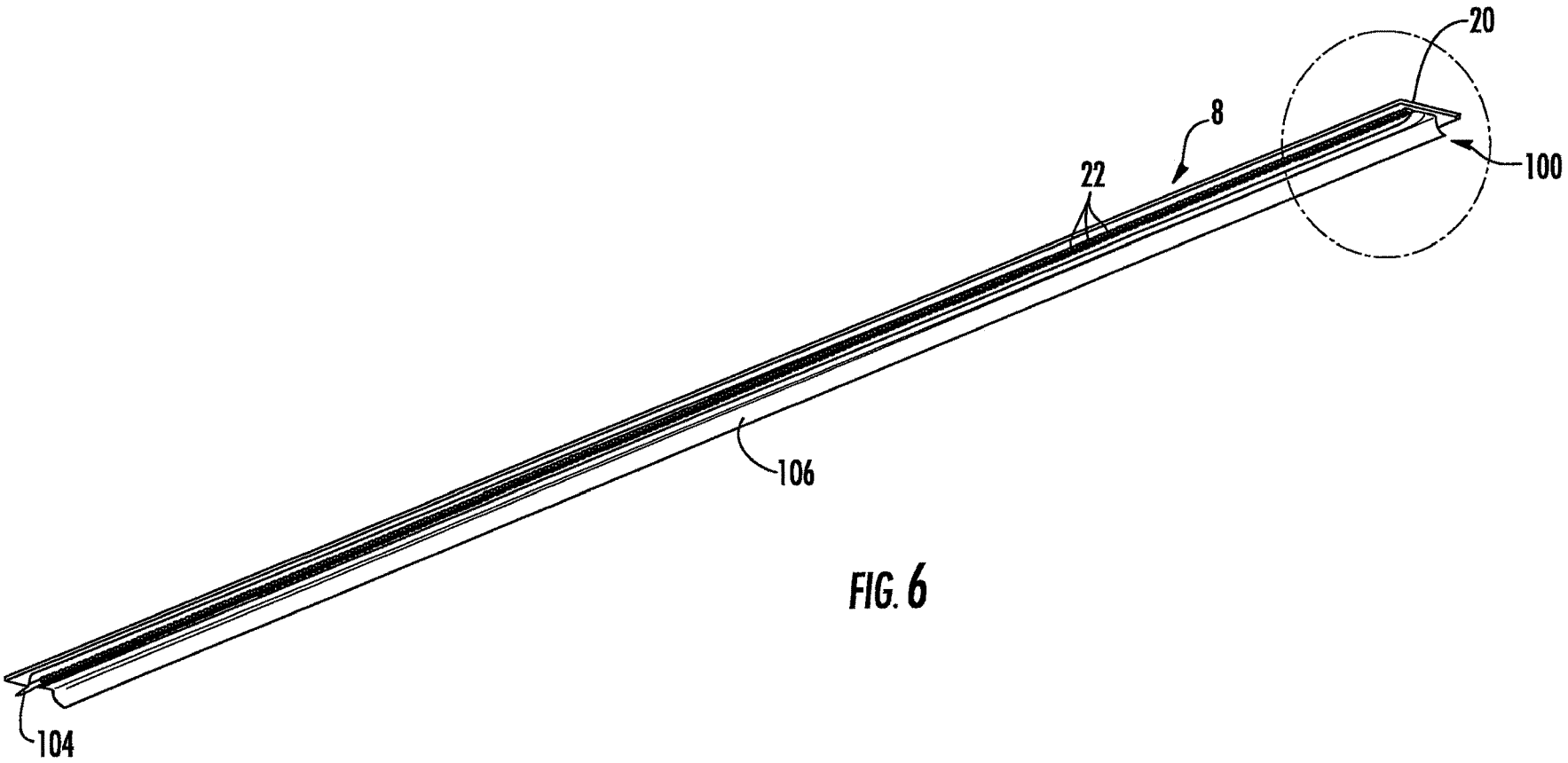
FIG. 6 is a plan view of the LED assembly and reflector assembly of the lighting fixture of FIG. 1.
Figure 7:
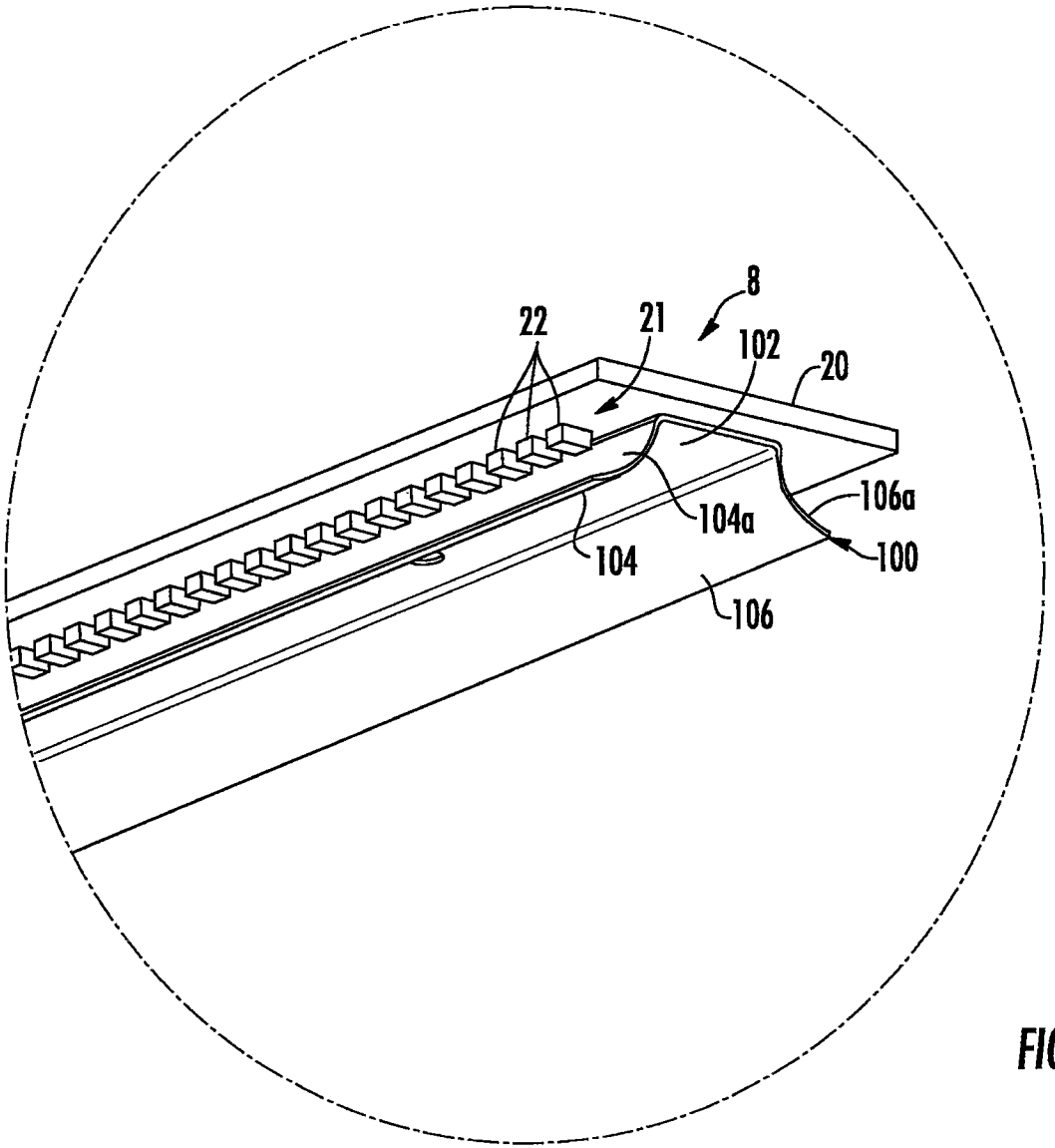
FIG. 7 is a detail view of FIG. 6.

The LED board 20 or multiple LED boards may be aligned with the longitudinal axis A-A of the housing 6 and lens 12. It is understood that nearly any length of LED board 20 can be used. In some embodiments, any length of LED board can be built by combining multiple boards together to yield the desired length. Referring to FIG. 4, the light fixture 1 comprises an elongated rigid support structure **14*a* supporting the LED assembly 8. The support structure 14*a* may comprise a thermally conductive material such that it functions as a heat sink to dissipate heat from the LED assembly 8. Moreover the support structure may be thermally coupled to or form part of the housing 6 such that heat from the LEDs is conducted to the housing via the support structure 14*a*. In the illustrated embodiment the support structure 14*a* forms part of the back panel 14. The LED board 20 provides physical support for the LEDs 22 and may form part of the electrical path to the LEDs for delivering current to the LEDs. The LED board 20 may be connected to the support structure 14*a* by any suitable connection mechanism including adhesive, screws, snap-fit connectors, board receptacles or the like. The term "electrical path" is used to refer to the entire electrical path to the LEDs 22, including an intervening power supply and all the electronics in the lamp disposed between the electrical connection that would otherwise provide power directly to the LEDs. Electrical conductors run between the LEDs and the source of electrical power, such as a buildings electrical grid, to provide critical current to the LEDs 22. The three differently colored LEDs, i.e., BSY1, BSY2 and BSR can be controlled separately using three independent strings, to enable good color mixing and to build color-tunable fixtures. In some embodiments, each of the BSY1 LEDs are on a first string, each of the BSY2 are on a second string and each of the BSR LEDs are on a third string where each of the first, second and third strings can be controlled separately. The color of the light emitted by the light fixture may be color tuned by controlling the output of the different colored LEDs independently. It is to be understood that the term "array" as used herein refers to the physical layout of the LEDs, e.g. linear LED arrays 21, 23** arranged on either side of the reflector, and not to the arrangement of the different types of LEDs in a string. Thus, each array may include LEDs of each of the first, second and third strings.

Further, any of the embodiments disclosed herein may include one or more communication components 29 (FIGS. 1 and 4) forming a part of the light control circuitry, such as an RF antenna that senses RF energy. The communication components 29 may be included, for example, to allow the luminaire to communicate with other luminaires and/or with an external wireless controller. More generally, the control circuitry includes at least one of a network component, an RF component, a control component, and a sensor. The sensor, such as a knob-shaped sensor, may provide an indication of ambient lighting levels thereto and/or occupancy within the room or illuminated area. The communication components such as a sensor, RF components or the like 29 may be mounted as part of the housing or lens assembly. As shown in FIG. 1 one or both of the end caps 10 and 11 may include an aperture 31M order to accommodate the communication components 29 such as a sensor, RF components, occupancy sensor assembly or the like if the light fixture is used with Smart Cast technology as previously described. Such a sensor may be integrated into the light control circuitry. In various embodiments described herein various smart technologies may be incorporated in the lamps as described in the following United States patent applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

Figure 8:
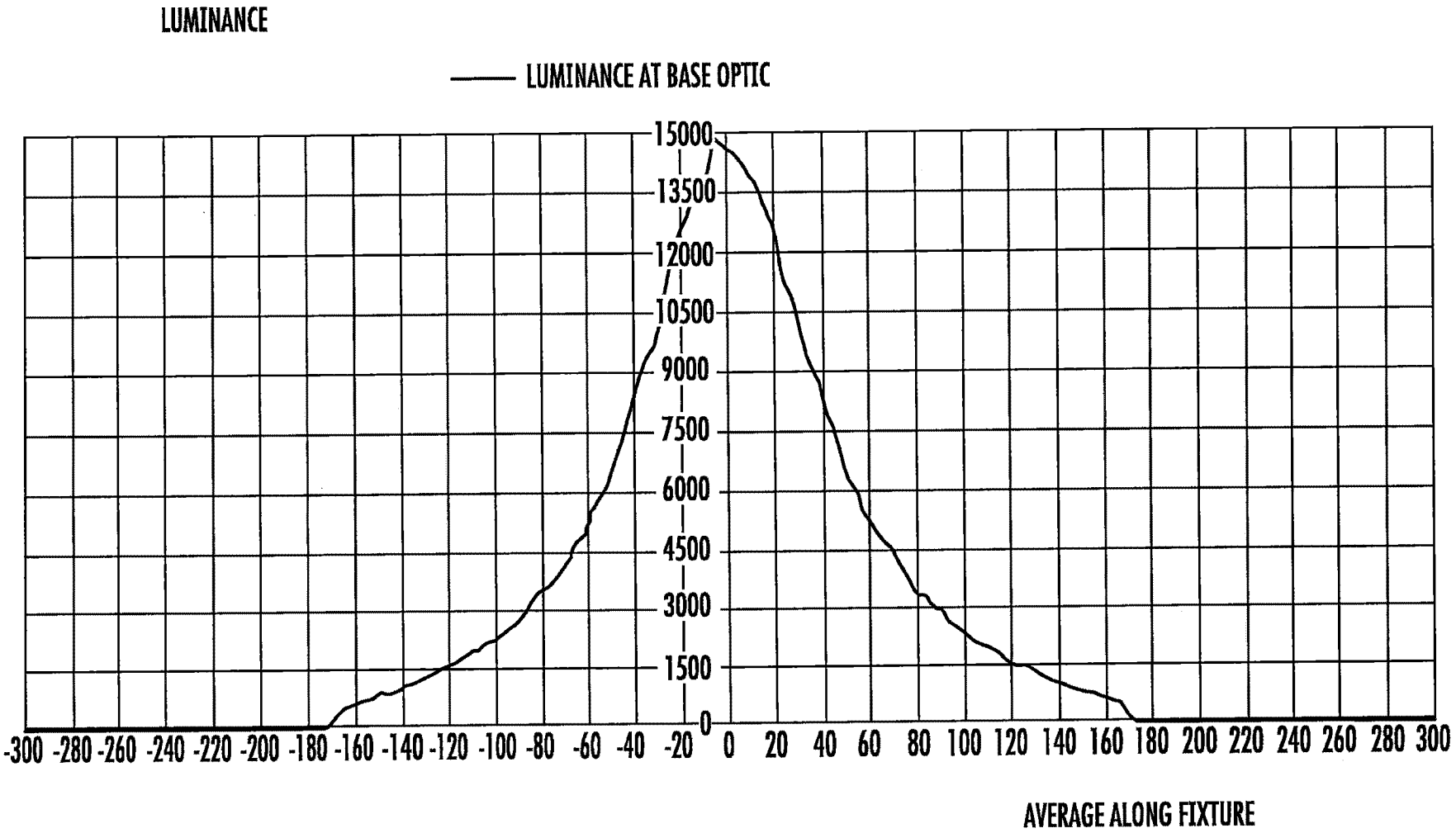
FIG. 8 is a luminance diagram of the lighting fixture useful in explaining the invention.

As previously explained, a linear array of LEDs such as arranged in a troffer-style LED fixture emit a Gaussian type of light distribution with a sharp peak luminance in the center. FIG. 8 shows a luminance graph for such a linear array having a sharp peak along the longitudinal axis of the linear array. As a result, a linearly arranged LED array will typically create a bright spot along the longitudinal axis A-A of the lens 2 with dimmer lateral sides. With a wider wide-fixture lens 2 the visible difference between the center peak and the dimmer sides becomes more apparent. In order to create uniformly distributed luminance to provide good color mixing and good tunable color points it is necessary to distribute the light across the lateral width W of the lens.

In one embodiment light from the linear array is distributed laterally across the width of the lens and color mixed by a reflector that is located between the two rows of LEDs 21, 23. Referring to FIGS. 3-7 and 9, in one embodiment the centers of the rows of LEDs 21, 23 may be separated from one another by distance D (FIG. 5) between approximately 5-20 mm with a reflector assembly 100 positioned between the rows of LEDs to reflect the light emitted by the LEDs laterally. In one embodiment, the two rows of LEDs are separated by approximately 15 mm. The reflector assembly 100 is positioned between and extends along the two rows of LEDs 21, 23 and comprises a base 102 that is secured to the LED board 20 such that two longitudinally extending reflectors 104, 106 extend along the two rows of LEDs 21, 23, with one reflector positioned adjacent each of the two rows of LEDs. The base 102 is used primarily to secure the reflectors 104, 106 to the LED board and to properly orient the reflectors 104, 106 relative to the LEDs 22. In the illustrated embodiment the base 102 extends for the length of the reflectors 104, 106; however, the base 102 may have other configurations. For example the base 102 may comprise a plurality of spaced members connecting the reflectors 104, 106. Moreover each reflector 104 and 106 may be provided with a separate base such that each reflector 104 and 106 and its associated base are mounted to the LED board independently of one another. Moreover, the base 102 may be connected to the housing, heat sink or other structure rather than to the LED board as shown.

Each reflector 104, 106 is configured to reflect the light emitted by its associated row of LEDs 21, 23 laterally towards the lateral sides of the lens 2. In one embodiment each reflector 104, 106 has a reflective surface 104*a*, 106*a*, respectively, that in cross-section is a generally cylindrical surface and in one embodiment each reflective surface 104*a*, 106*a* has a generally parabolic shape and more particularly has a half parabolic shape. In other embodiments the reflective surfaces 104*a*, 106*a* may in cross-section have a splined curved shape where the curve of the reflectors in cross-section is formed by a plurality of surfaces that may be arranged to target the lighting direction of portions of the light. The LEDs 22 and reflectors 104, 106 are arranged such that the LEDs 22 in each row 21, 23 are arranged in a substantially straight line and are disposed at or near the focal point of the reflective surfaces 104*a*, 106*a*, respectively, along the entire length of the reflective surfaces 104*a*, 106*a*. The reflectors may be symmetrical such that the light is reflected evenly to the two sides of the lens. Each reflective surface 104*a*, 106*a* receives and reflects a major portion of the light emitted by the associated row of LEDs. In some embodiments each of the reflective surfaces 104*a*, 106*a* receives and reflects approximately 65-75% of the light emitted by the associated array of LEDs while approximately 25-35% of the light emitted by the LEDs travels to fixture lens 2 without hitting the reflector surfaces and in one embodiment each of the reflective surfaces 104*a*, 106*a* receives and reflects approximately 70% of the light emitted by the associated array of LEDs while approximately 30% of the light emitted by the LEDs travels to fixture lens 2 without hitting the reflector surfaces. The reflective surfaces 104*a*, 106*a* are disposed over the top of the LEDs and in some embodiments cover over 90° and in some embodiments cover approximately 125° of the LEDs in a lateral direction, e.g. in vertical cross-section as viewed in FIG. 5. The light reflected off of the reflective surfaces 104*a*, 106*a* is directed primarily laterally such that the reflected light is projected toward the sides 30 of lens 2. The light that is not reflected by the reflective surfaces, in large party propagates directly to the lens surface or propagates directly to and is reflected off of the troffer housing.

The reflector assembly 100 may be made of a highly reflective material. The reflector may be made of a specular material or a material(s) having a combination of specular and diffuse reflective properties. The reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. The reflectors could also be formed polished aluminum, or Alanod's Miro® or Miro Silver® sheet.

Figure 9:
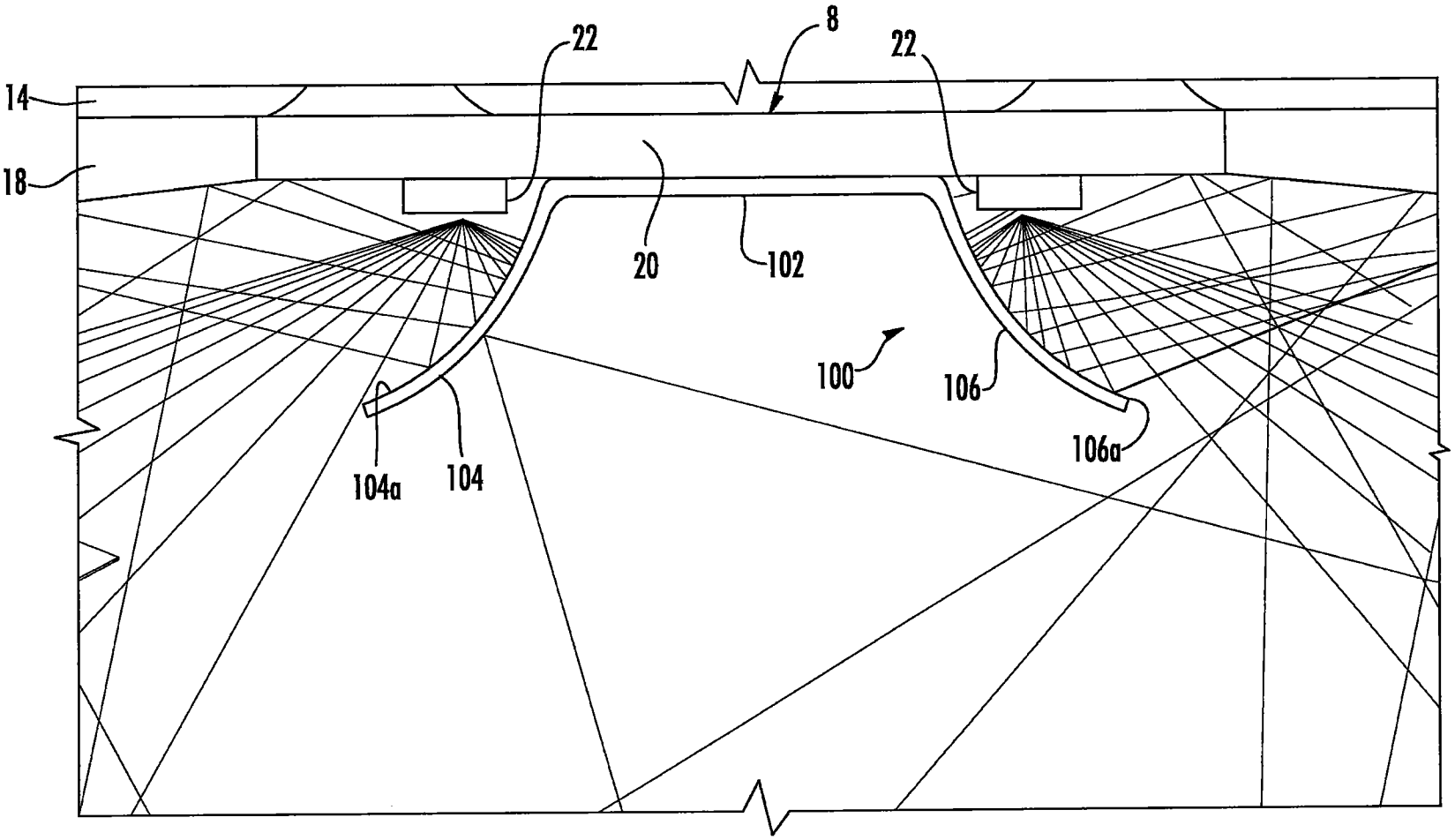
FIG. 9 is a detail view of the lighting fixture of FIG. 1 showing a light emitting pattern.
Figure 10:
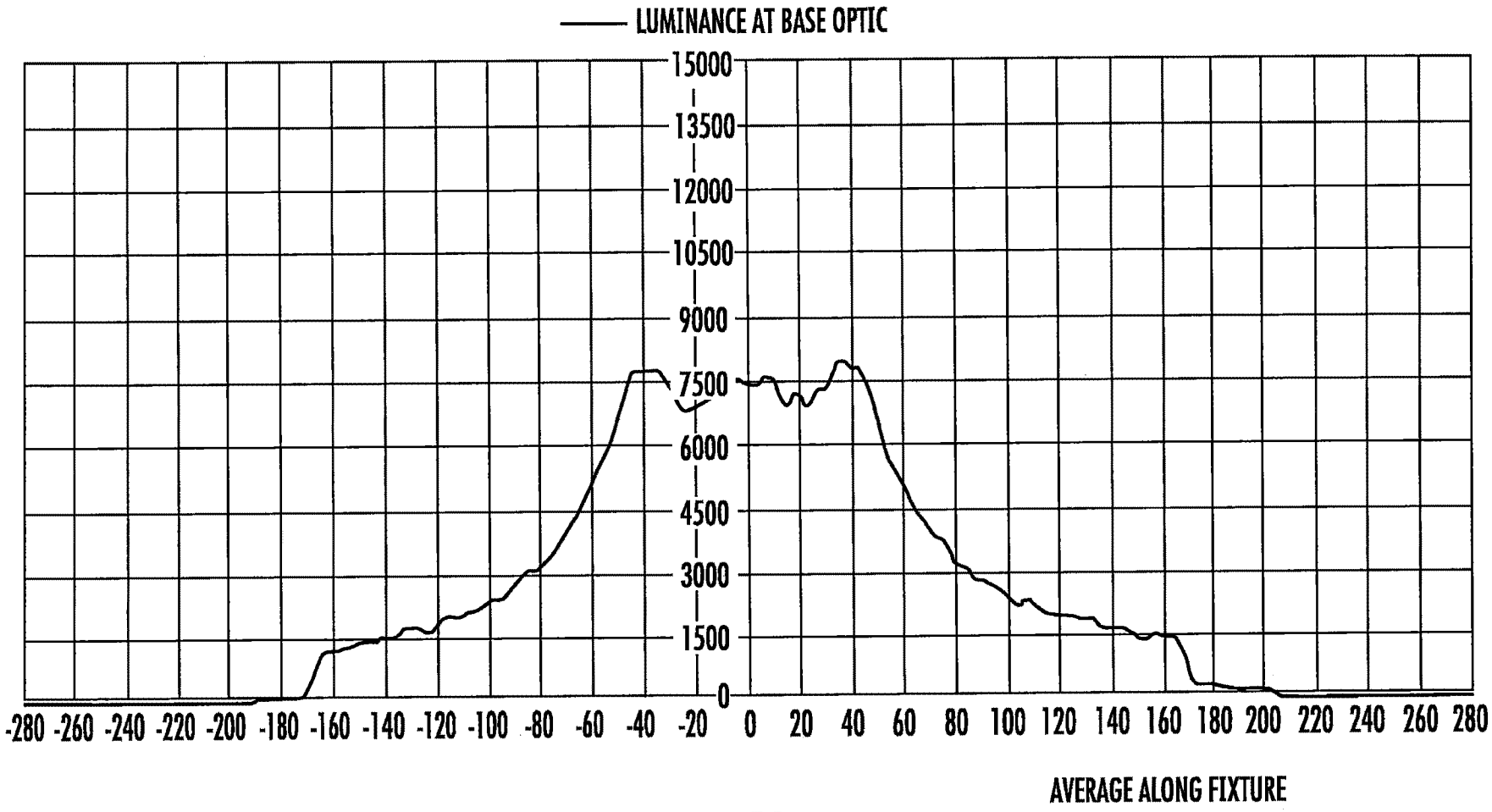
FIG. 10 is a luminance diagram of the lighting fixture of FIG. 9.
Figure 31:
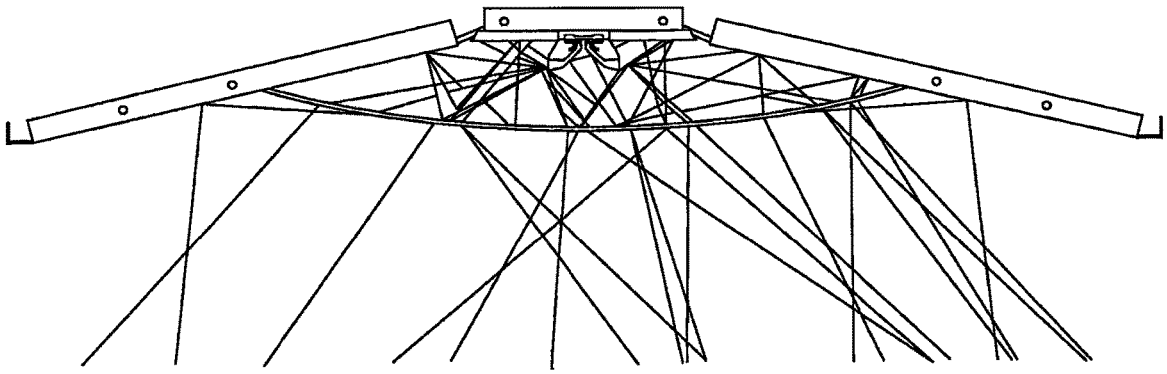
FIG. 31 is a section view showing a light emitting pattern of the lighting fixture.

FIG. 9 is a schematic view showing the reflection of the light off of reflective surfaces 104*a* and 106*a*. As is evident from FIG. 9 a substantial portion of the light is reflected off of reflective surfaces 104*a*, 106*a* laterally toward the sides of lens 2. FIG. 10 is a luminance graph for such an arrangement where, when compared to the luminance graph of FIG. 8 for a linear array without the reflector, the large central peak is eliminated and light is more evenly distributed across the width of the lens. The luminance graphs shown herein are at the lens surface. The emission patterns shown in FIGS. 9, 17, 27 and 28 are the light emission patterns at the LED/reflector assembly. The light, is further mixed and dispersed by the diffusive white surfaces of the troffer housing. FIG. 31 shows a light emission pattern for the light fixture itself. As is evident, the light, after being reflected by the reflector assembly 100 is diffusively reflected by the white diffusive surfaces of the troffer housing to provide a wide luminance pattern that fills the wide-fixture lens 2 such that the lens surface is substantially illuminated across its width and the light is color mixed to avoid visible color spots.

Figure 12:
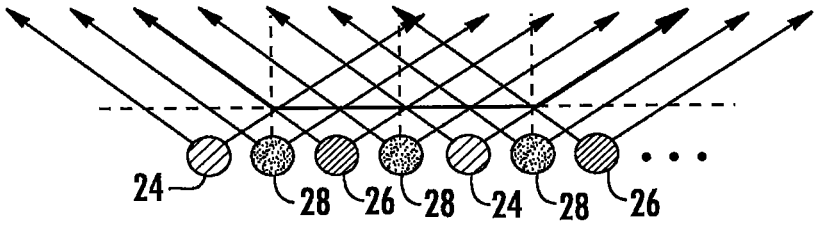
FIGS. 12 and 13 are diagrams useful for explaining the light color mixing of the light fixture of the invention.
Figure 13:
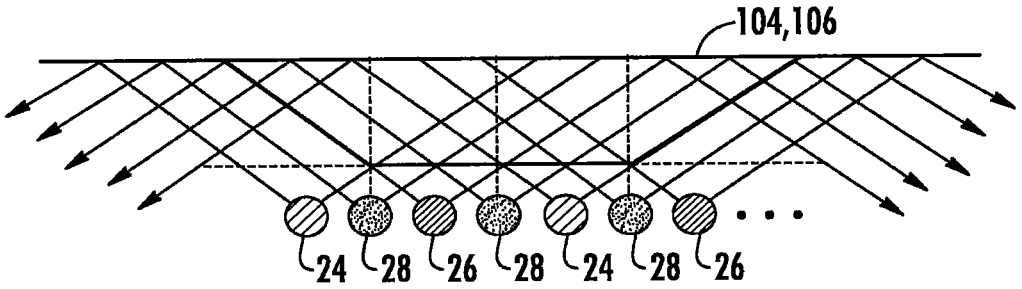

The arrangement of the LEDs and the use of the reflector assembly 100 provides good color mixing across the lens. Referring to FIG. 12 a linear array of LEDs arranged as previously described is shown without a reflector where the alternating arrangement of the LEDs described with reference to FIG. 11 provides good color mixing. FIG. 12 shows the same arrangement of LEDs with a reflector 104, 106 where the light reflected off of the reflector further color mixes the light and provides an even luminance across the lens, while giving desirable intensity distribution.

Figure 14A:
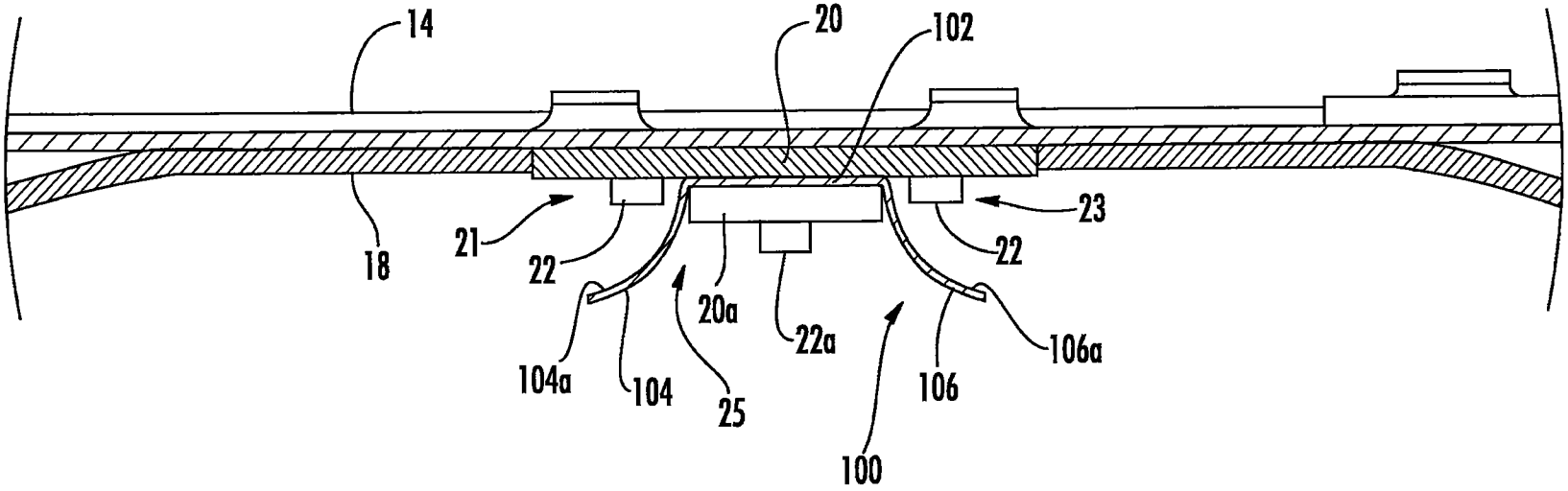
FIG. 14A is a section view of another embodiment of a troffer-style lighting fixture.
Figure 14B:
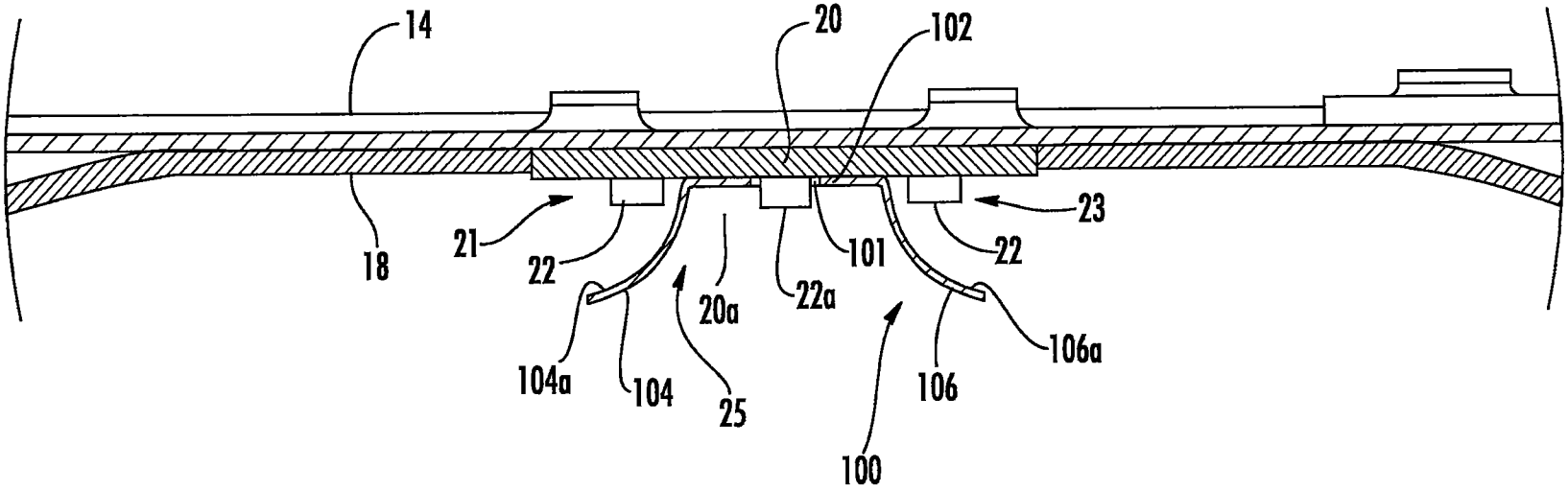
FIG. 14B is a section view of yet another embodiment of a troffer-style lighting fixture.
Figure 15:
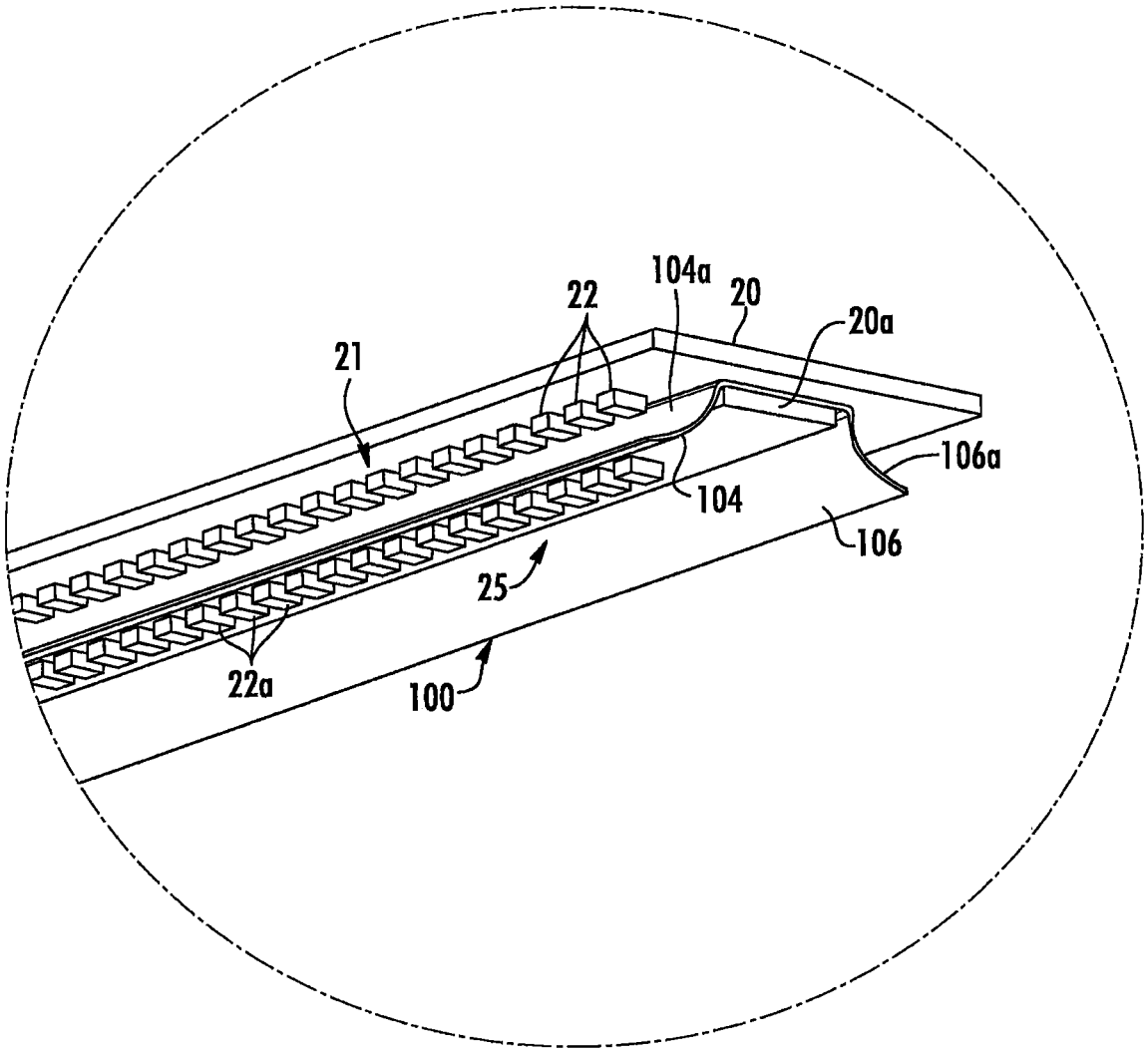
FIG. 15 is a perspective view of the lighting fixture of FIG. 14.

The arrangement of the LED assembly shown in FIGS. 5-7 and 9 provides good color mixing and creates uniformly distributed luminance and distributes the light across the width of the lens. However, in some embodiments a relatively darker visible line may be created along the longitudinal axis A-A of the lens 2 directly over the reflector assembly 100 due to the lateral reflection of the light generated by reflectors 104 and 106 and due to the shadow and diffraction by the edge of the reflector 104 & 106. To eliminate this relatively darker line, a third linear array 25 of LEDs may be provided between the linear arrays 21 and 23 to provide illumination that is generally perpendicular to the LED assembly along the longitudinal axis A-A as shown in FIGS. 14A-17. The LED array 25 comprises a LED board 20*a* with LEDs 22*a* as previously described. The light emitted by the LED array 25 emits light directly toward the center of the lens 2 and illuminates the relatively darker central region of the lens as shown in FIG. 17 in a controlled manner by controlling the LEDs in LED array 25 separately from the LEDs in arrays 21 and 23. While, in FIG. 14A, the LED board 20*a* is shown mounted to base 102 of reflector assembly 100 other constructions may be used. For example where each reflector 104 is provided with its own base the LED board may be mounted between the bases. Alternatively, as shown in FIG. 14B, the LEDs in array 25 may be mounted along the longitudinal center line of the LED board 20, rather than on a separate LED board 20*a*, and holes 101 may be formed in base 102 that receive the LEDs in array 25 allowing the LEDs to extend into the holes such that light emitted by the LED array 25 emits light directly toward the center of the lens 2.

Figure 16:
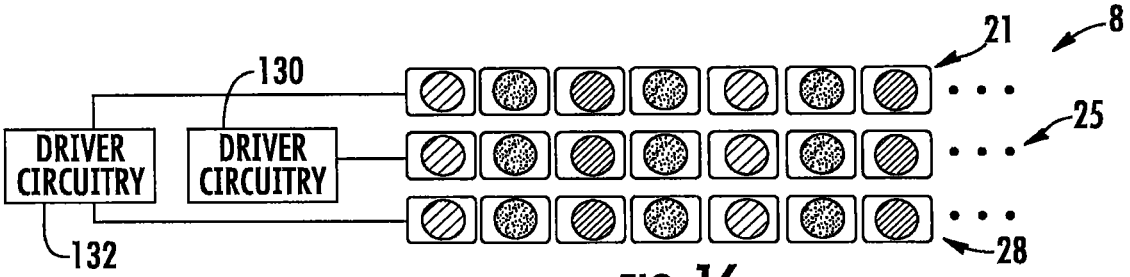
FIG. 16 is a view showing the arrangement of the LEDs in the lighting fixture of FIGS. 14 and 15.
Figure 17:
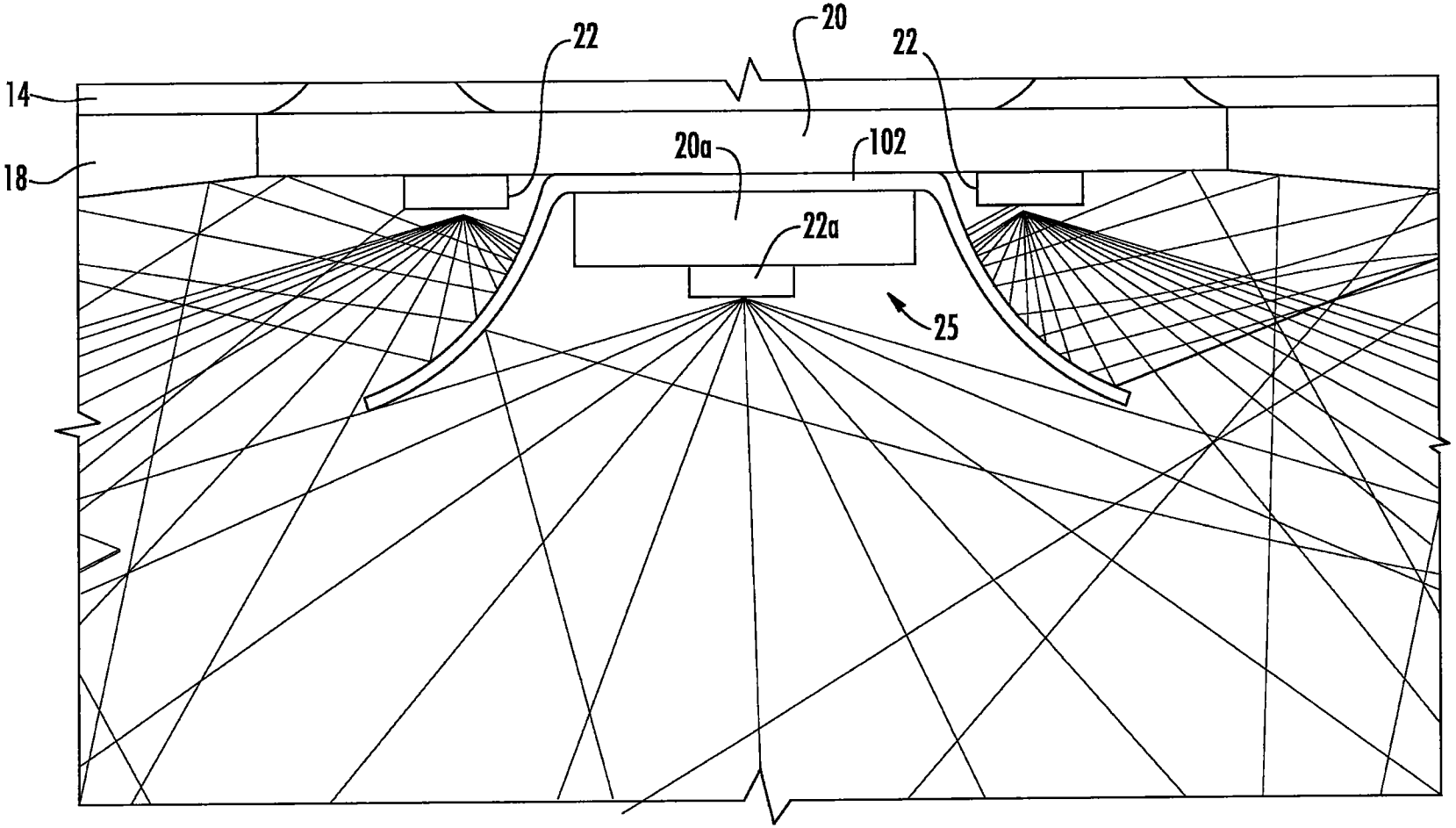
FIG. 17 is a detail view of the lighting fixture of FIG. 14 showing a light emitting pattern.

In order to balance the direct light emitted from the LED array 25 with the reflected light emitted by LED arrays 21 and 23, LED array 25 may be operated on separate driver circuitry from LED arrays 21 and 23 as shown in FIG. 16 where the LEDs in array 25 are driven at lower power. In one example embodiment, LED array 25 includes LEDs arranged in the same alternating sequence as arrays 21 and 23 where the LEDs in array 25 are driven by first driver circuitry 130 at approximately 10-30% of the power of the LEDs in arrays 21 and 23, driven by second driver circuitry 132. In one embodiment the LEDs in array 25 are driven at approximately 20% of the power of the LEDs in arrays 21 and 23.

Figure 18:
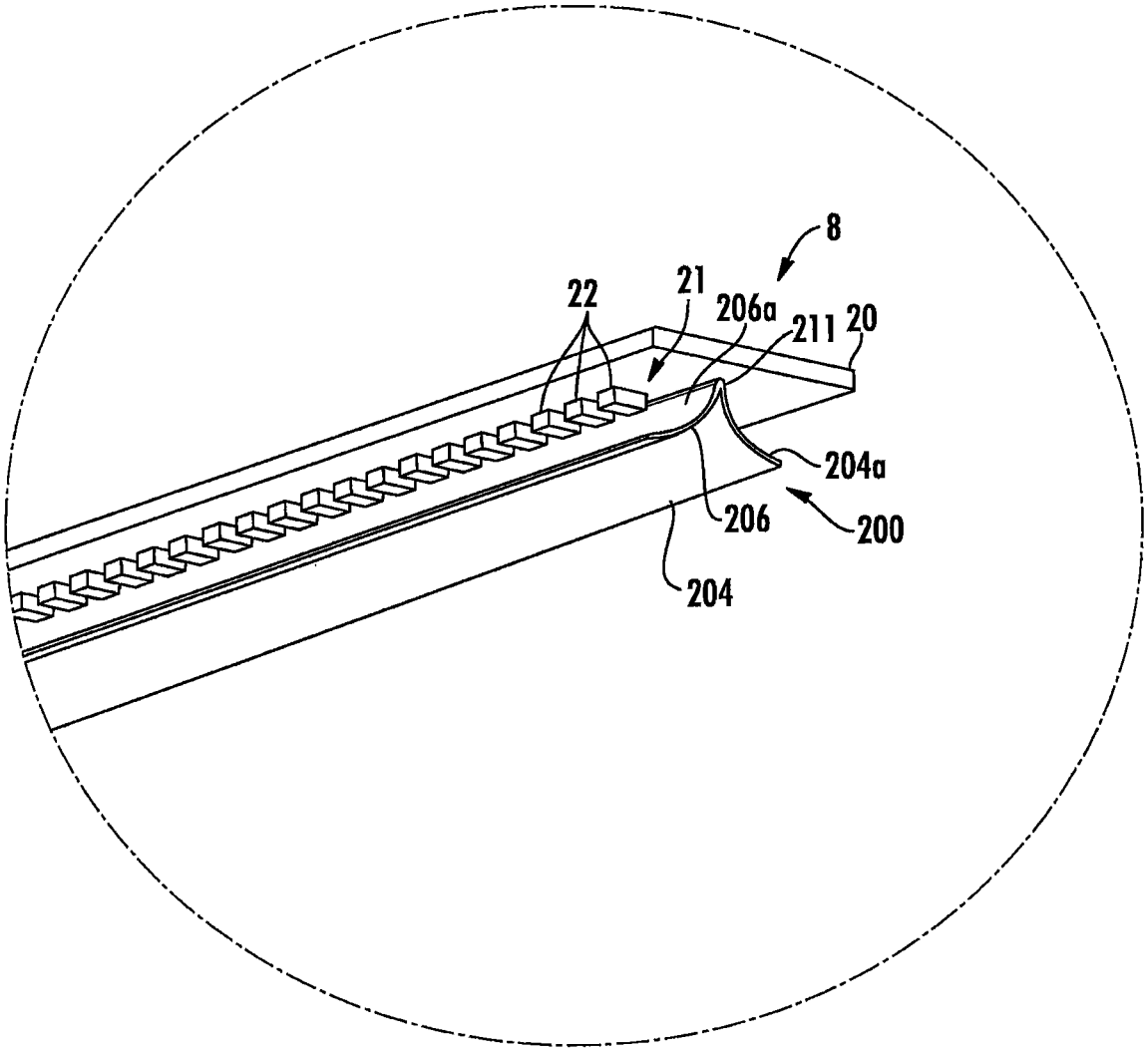
FIG. 18 is a perspective view of another embodiment of the LED assembly and reflector assembly of the lighting fixture.
Figure 19:
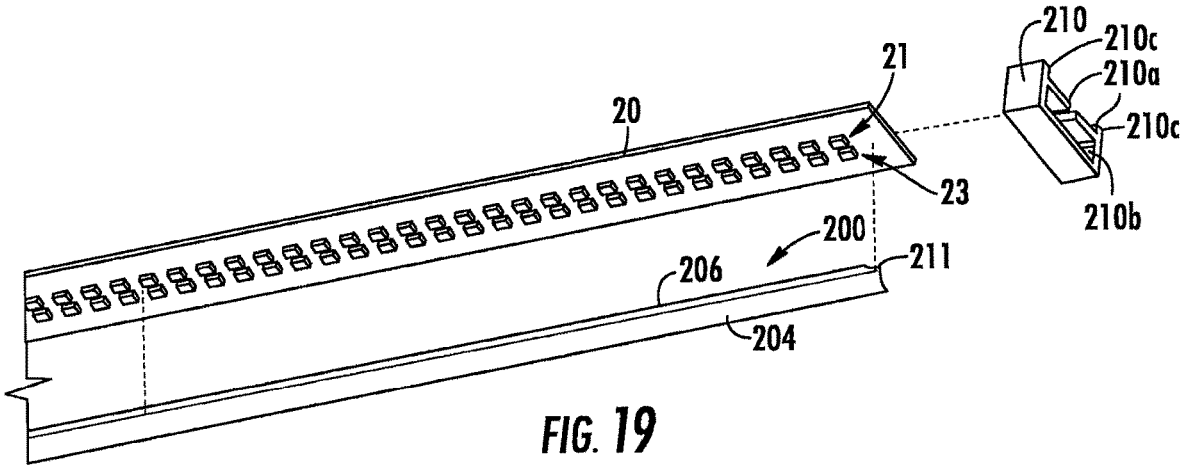
FIG. 19 is an exploded perspective view of the lighting fixture of FIG. 18.
Figure 20:
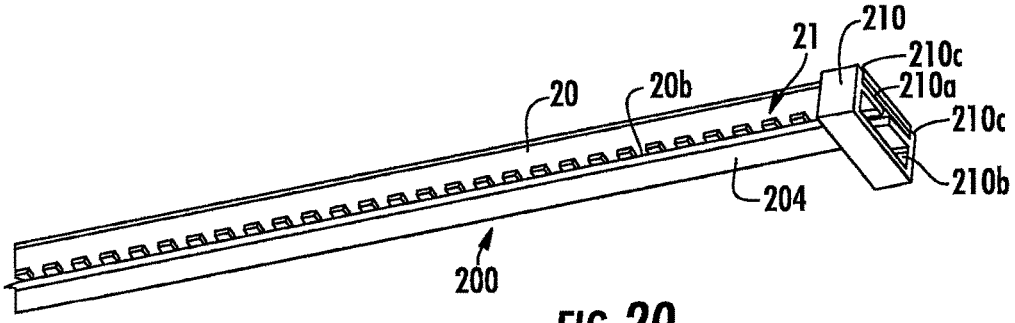
FIG. 20 is a perspective view of the lighting fixture of FIG. 18 with mounting hardware.

Referring to FIGS. 18-20 in another embodiment the two rows of LEDs 21, 23 are more closely spaced than in the prior embodiments. In the embodiment of FIGS. 18-20 the two linear LED arrays 21 and 23 are separated by approximately 5 mm. A reflector assembly 200 is positioned between the two rows of LEDs and comprises two longitudinally extending reflectors 204, 206 extending along the two linear arrays 21, 23, with one reflector positioned adjacent each of the two rows of LEDs. The longitudinal proximal edges of the reflectors 204, 206 are connected together at joint 211 without flat base 102 of the prior embodiment to create a reflector having a narrower width. Each reflector 204, 206 is configured to reflect the light emitted by its associated row of LEDs 21, 23 laterally towards the lateral sides of the lens 2. As previously explained, each reflector 204, 206 has a reflective surface

204*a*, 206*a*, respectively, that in cross-section is a generally cylindrical surface and in one embodiment each reflective surface 204*a*, 206*a* has a generally parabolic shape and more specifically is shaped as a half parabola or optimized spline curves. Because the proximal edges of the reflectors 204 and 206 are connected to one another or closely adjacent to one another, the embodiment of FIGS. 18-20 does not have a base 102 that may be easily connected to the light fixture. Clips 210 may be used at either end of the assembly to connect the reflector assembly 200 to the LED assembly and to connect these components to the housing 6. The clips 210 may include apertures or slots 210*a* and 210*b* for receiving the ends of the LED board 20 and the reflector assembly 200 to align and hold these components together. The reflector assembly 200 may be held in the clips 210 by a friction fit, separate fasteners, adhesive, mechanical connection or the like. The clips 210 may be secured to the back panel 14 of housing 6 to secure the reflector assembly in the housing. Slot 210*a* is open such that the extending legs 210*c* may straddle the LED board 20 and be mounted to the enclosure. This arrangement allows the LED board to be mounted on surface 14*a* such that heat may be dissipated from the LED board to the surface. Clips 210 may be used at either end of the LED assembly and may also be disposed at spaced intervals along the length of the LED assembly. Other mechanisms for connecting the components together may be used and the clips of FIGS. 19 and 20 may be used to connect the components together in any of the embodiments described herein. Moreover, as previously explained each reflector 204, 206 may be mounted to the LED board independently of one another.

As previously described the LEDs 22 and reflector assembly 200 are arranged such that the LEDs are arranged in a substantially straight line and are disposed at or near the focal point of the reflective surfaces 204*a*, 206*a*. The reflectors may be symmetrical such that the light is reflected evenly to the two sides of the lens. Each reflective surface 204*a*, 206*a* receives and reflects a major portion of the light emitted by the associated row of LEDs. In some embodiments each reflector receives and reflects approximately 65-75% of the light emitted by the associated array of LEDs and in one embodiment each reflector reflects approximately 70% of the light emitted by the associated array of LEDs. The reflective surfaces are disposed over the top of the LEDs such that the reflective surfaces substantially cover the LEDs and in some embodiments cover over 90° and in some embodiments cover approximately 125° of the LEDs in a lateral direction, as previously described. The light reflected off of the reflective surfaces 204*a*, 206*a* is directed primarily laterally such that the reflected light is projected toward the sides of lens 2. The light that is not reflected by the reflective surfaces, in large party propagates directly to the lens surface while a small portion of the light propagates directly to the troffer housing.

As previously described the reflector assembly 200 may be made of a highly reflective material. The reflector may be made of a specular material or a material(s) having a combination of specular and diffuse reflective properties. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. The reflectors could also be formed polished aluminum, or Alanod's Miro® or Miro Silver® sheet.

Figure 21:
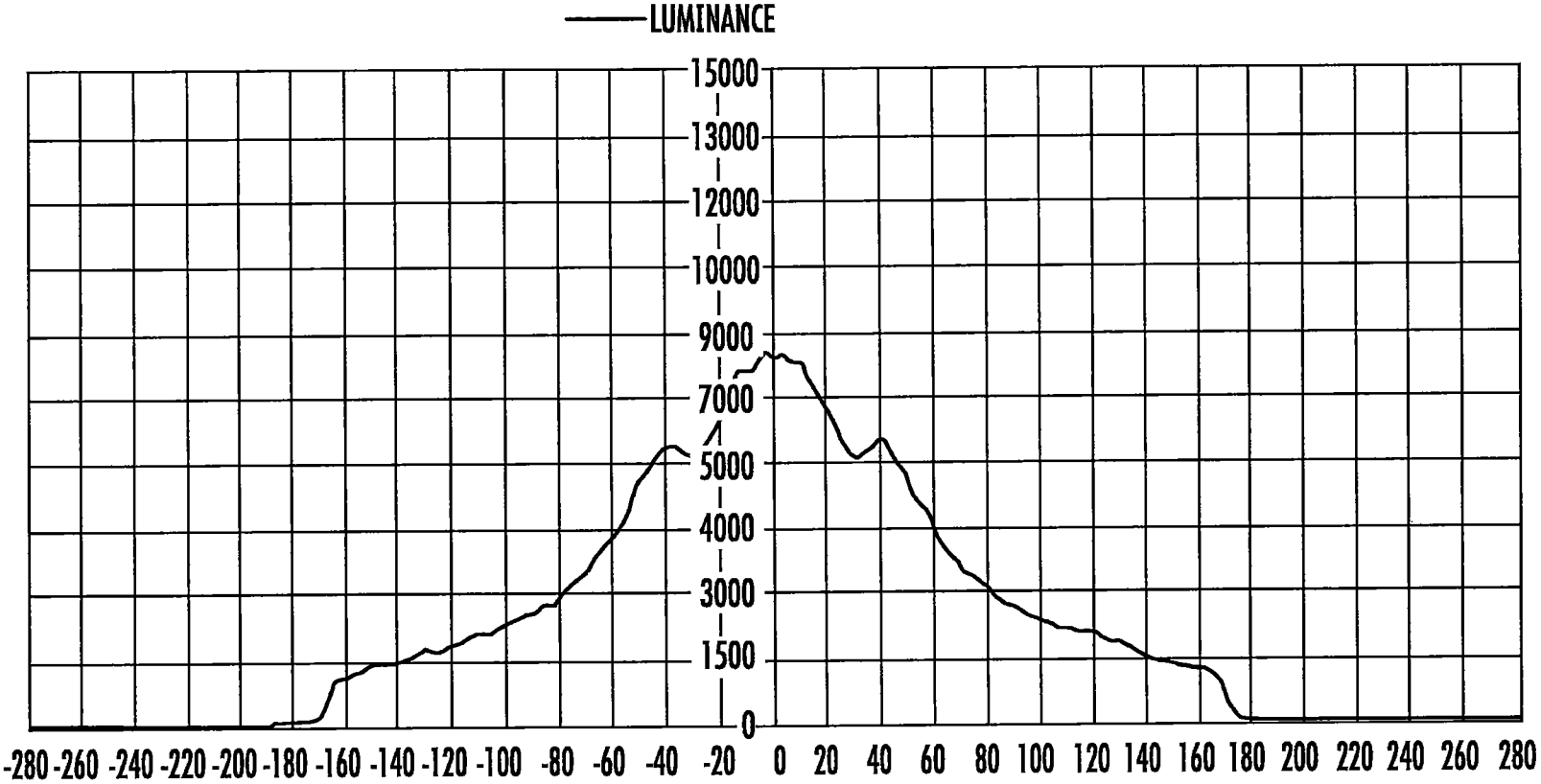
FIG. 21 is a luminance diagram of the lighting fixture using the assembly of FIG. 18.

FIG. 21 is a luminance diagram for an LED assembly using the reflector assembly described with respect to FIGS. 18-20, when compared to the luminance diagram of FIG. 8 for a linear array without the reflector, the large central peak is eliminated and light is more evenly distributed across the width of the lens.

Figure 22:
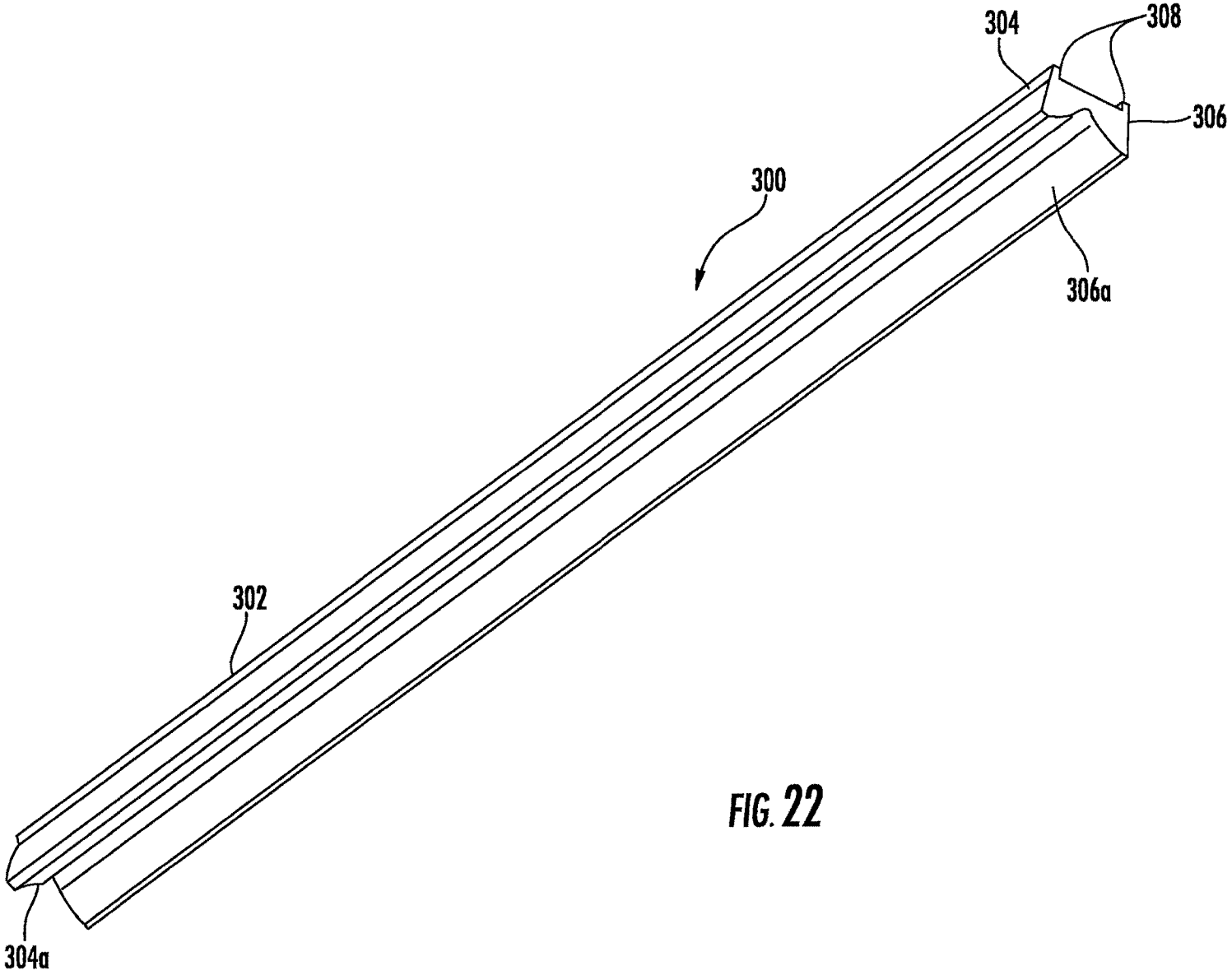
FIG. 22 is a perspective view of another embodiment of a reflector assembly of the lighting fixture.
Figure 23:
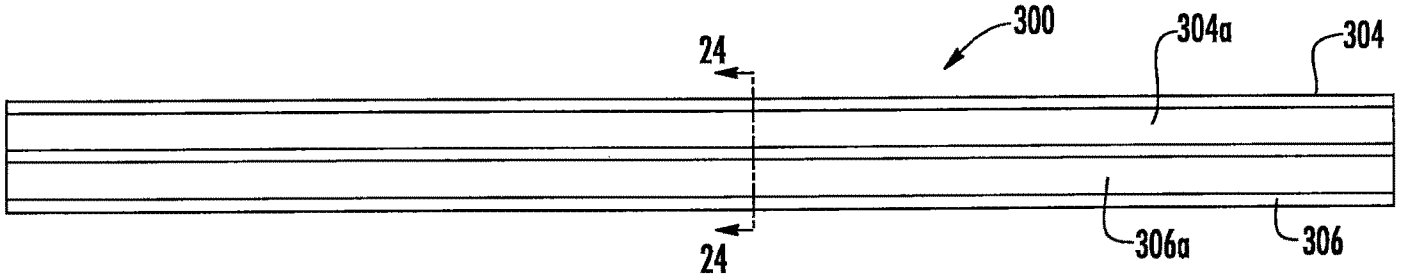
FIG. 23 is a plan view of the LED assembly and reflector assembly of FIG. 22.
Figure 24:
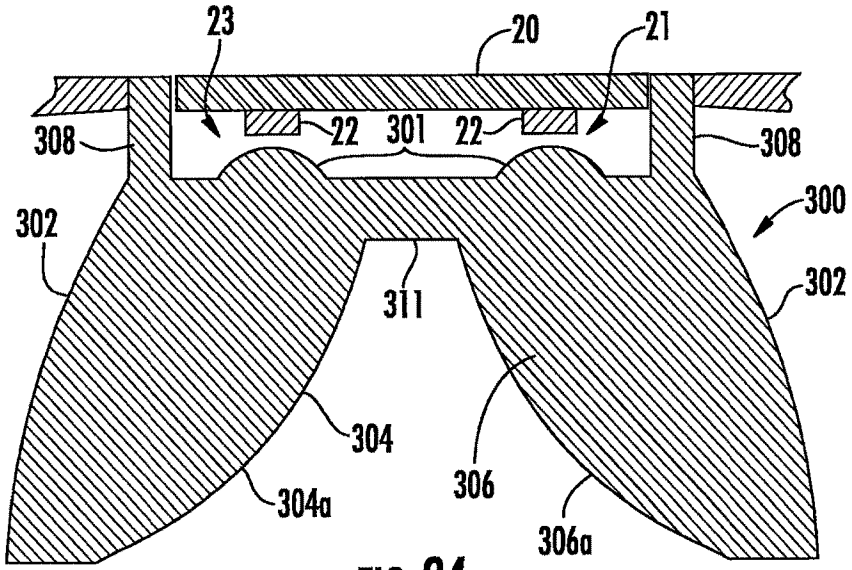
FIG. 24 is a section view taken along line 24-24 of FIG. 23.

Referring to FIGS. 22-24 in another embodiment two rows of LEDs 21, 23 are provided as previously described. A TIR optical element or TIR reflector assembly 300 is provided adjacent the two rows of LEDs. The TIR element functions as a reflector to reflect the light and distribute the light laterally across the lens. An optical element that exhibits total internal reflection (TIR), a "TIR optical element," is essentially a lens made of transparent material designed in such a way that light, once having entered into the transparent media, encounters the side walls of the lens at angles greater than the critical angle, resulting in total internal reflection. In example embodiments, the optic is substantially made of clear, optical material such as glass or plastic. Such material may have an index of refraction of approximately 1.5. The refractive indices of glasses and plastics vary, with some having an index of refraction as low as 1.48 and some having an index of refraction as high as 1.59. In one embodiment the TIR optical element is made of acrylic. Typical TIR optical elements include one or more entry surfaces 301, one or more exit surfaces 302, and one or more outer reflective surfaces 304 that internally reflect light. The reflective surfaces are often curved in shape, so that light rays hitting at various angles depending on where on the sidewall a ray is striking, will always be reflected at an angle greater than the critical angle. In the present invention reflective surfaces 304 comprise external walls of the optical element and have a parabolic shape or optimized splice curves. However, it should be noted that this is one embodiment of how the outer surface of the TIR reflector may be shaped. The TIR optical element could be designed with outer reflective surfaces of various shapes; for example, angled, arced, spherical, curved as well as segmented shapes. The TIR optical element can be compact and include features on the exit surfaces 302 to modify the light distribution. Such features might include, for example, color mixing treatment or diffusion coatings. Reflective surfaces 304 as shown in the example embodiments disclosed herein may be used to provide total internal reflection (TIR), however, in at least some embodiments, the cross-sectional curve of surface may include several segmented TIR curve sections combined to maximize the TIR characteristics of the optic and reduce the dimensions of the TIR lens height. The entry surfaces 301 of the TIR optical element and the exit surfaces 302 may be made diffusive to prevent hot spots.

Mounting feature 308 is provided to seat a portion the TIR reflector assembly 300 and align the LEDs 22 and the TIR reflector to maintain an appropriate distance between the TIR reflector and the LEDs. Mounting feature 308 serves as a spacer to maintain the various optical surfaces of the optical element at an appropriate distance from the LEDs. Mounting feature 308 may be molded into and form a part of the optic. Alternatively, mounting feature 308 may be a separate component and may or may not be made of a different material than the main portion of TIR reflector assembly 300. In such a case, mounting feature 308 might be fastened to the rest of reflector assembly 300 with adhesive. The mounting feature can also be attached to or supported by a structure adjacent to the main body of the TIR reflector such as a portion of the housing 6.

The TIR reflector assembly 300 includes reflector bodies 304, 306. The reflector bodies include a curved entry surface 301 associated with each linear LED array 21, 23. In example embodiments, the LEDs 22 are opposite the radial center of the entry surfaces 301. The entry surfaces 301 direct at least a portion of the light emitted by LEDs 22 to symmetric TIR reflective surfaces 304*a*, 306*a* of reflector bodies 304, 306. For color-mixed and luminance-balanced distribution on a wide fixture-lens surface, symmetric reflective surfaces 304*a*, 306*a* are used. Each group of linearly arrayed LEDs 21, 23 is located at the spot lines of the reflective surfaces 304*a*, 306*a*, respectively, to maximize collect light and extract in each side directions. In some embodiments the pair of TIR reflector bodies 304, 306 may be connected by a flange 311 of the same material so that the TIR reflector assembly can be assembled on LED board as a single assembly. In other embodiments the TIR reflector bodies 304, 306 may not be connected and the reflector bodies 304, 306 may be connected to the LED board independently of one another.

At least some of the light from the TIR reflector 300 is reflected diffusely again on the diffusive surfaces of the troffer housing 6 prior to exiting the fixture via wide fixture lens 2. Light reflected from the white diffusive surfaces of the housing 6 and light emitted directly from the LEDs 22 are combined on the wide-fixture lens 2. These multi-passes help in generating an efficient color mixing and uniform luminance distribution.

Figure 25:
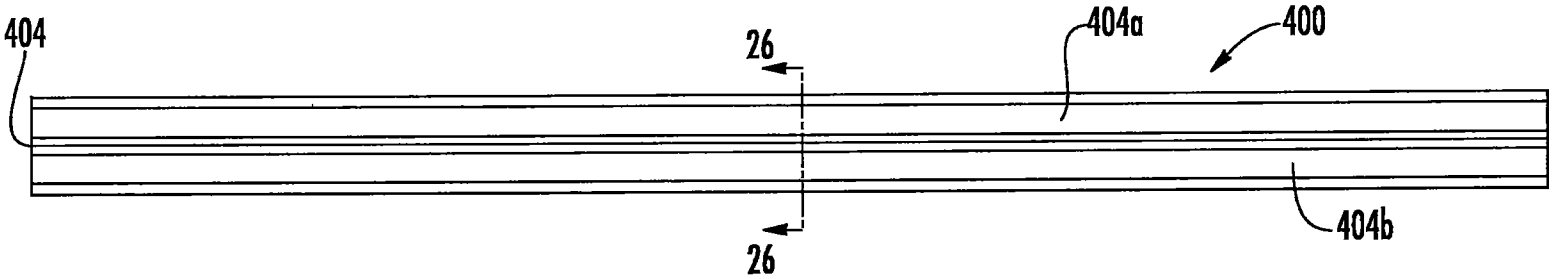
FIG. 25 is a plan view of another embodiment of the LED assembly and reflector assembly of the lighting fixture.
Figure 26:
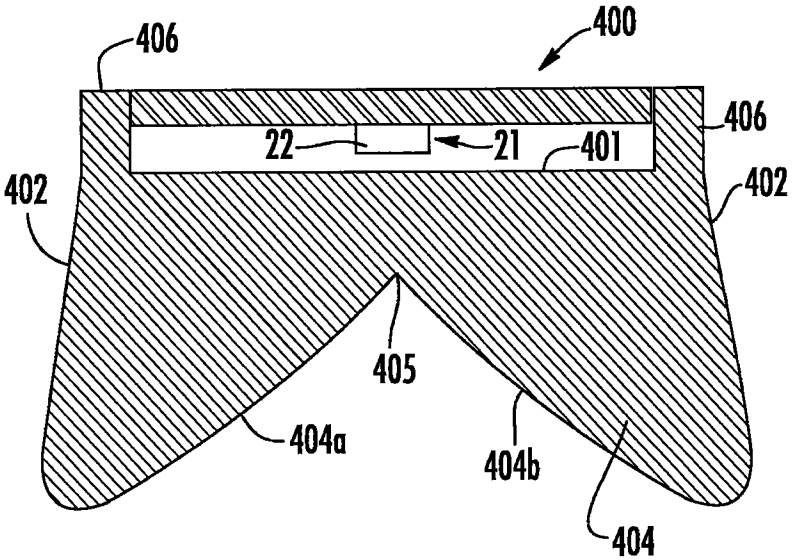
FIG. 26 is a section view taken along line 26-26 of FIG. 25.

Referring to FIGS. 25-26 in another embodiment a single row 21 of LEDs 22 is provided with the LEDs arranged as previously described. A TIR optical element is provided adjacent the row 21 of LEDs and comprises a TIR reflector assembly 400 that distributes the light from the single linear array of LEDs laterally to both sides of lens 2. The TIR reflector assembly 400 includes a reflector body 404 comprising one entry surface 401 and two exit surfaces 402. The reflector body further comprises two outer sidewalls or reflective surfaces 404*a*, 404*b* that internally reflect light. In the present invention the reflective surfaces 404*a*, 404*b* have a splined shape but may have other shapes as previously described. As previously described a mounting feature 406 is provided for aligning the LEDs 22 and the TIR reflector assembly 400 and maintaining an appropriate distance between the TIR reflector 400 element and the LEDs 22.

The entry surface 401 directs at least a portion of the light emitted by LEDs 22 to each of the TIR surfaces 404*a*, 404*b*. For color-mixed and luminance-balanced distribution on a wide fixture-lens surface, symmetric TIR surfaces 404*a*, 404*b* are used where the light from the LEDs 22 is evenly split between the two reflective surfaces 404*a*, 404*b*. In one embodiment the LEDs 22 are disposed relative to TIR reflector assembly 400 such that the LEDs are disposed along a dividing line 405 between the reflective surfaces 404*a*, 404*b* such that half of the light emitted by LEDs 22 is directed to the reflective surfaces 404*a*, and half of the light emitted by LEDs 22 is directed to the other one of the reflective surfaces 404*b*. LED arrangement for the single linearly arrayed LEDs is the same as described previously, i.e., BSY1, BSR, BSY2, BSR, BSY1, BSR, and so on.

At least some of the light emitted from the TIR reflector 400 is reflected diffusely again on white diffusive surfaces of the housing 6 to exiting the fixture via wide fixture lens 2. Light reflected from the white diffusive surfaces 18 of the fixture housing 6 and light emitted directly from the LEDs 22 are combined on the wide fixture-lens 2. These multi-passes help in generating an efficient color mixing and uniform luminance distribution.

Figure 27:
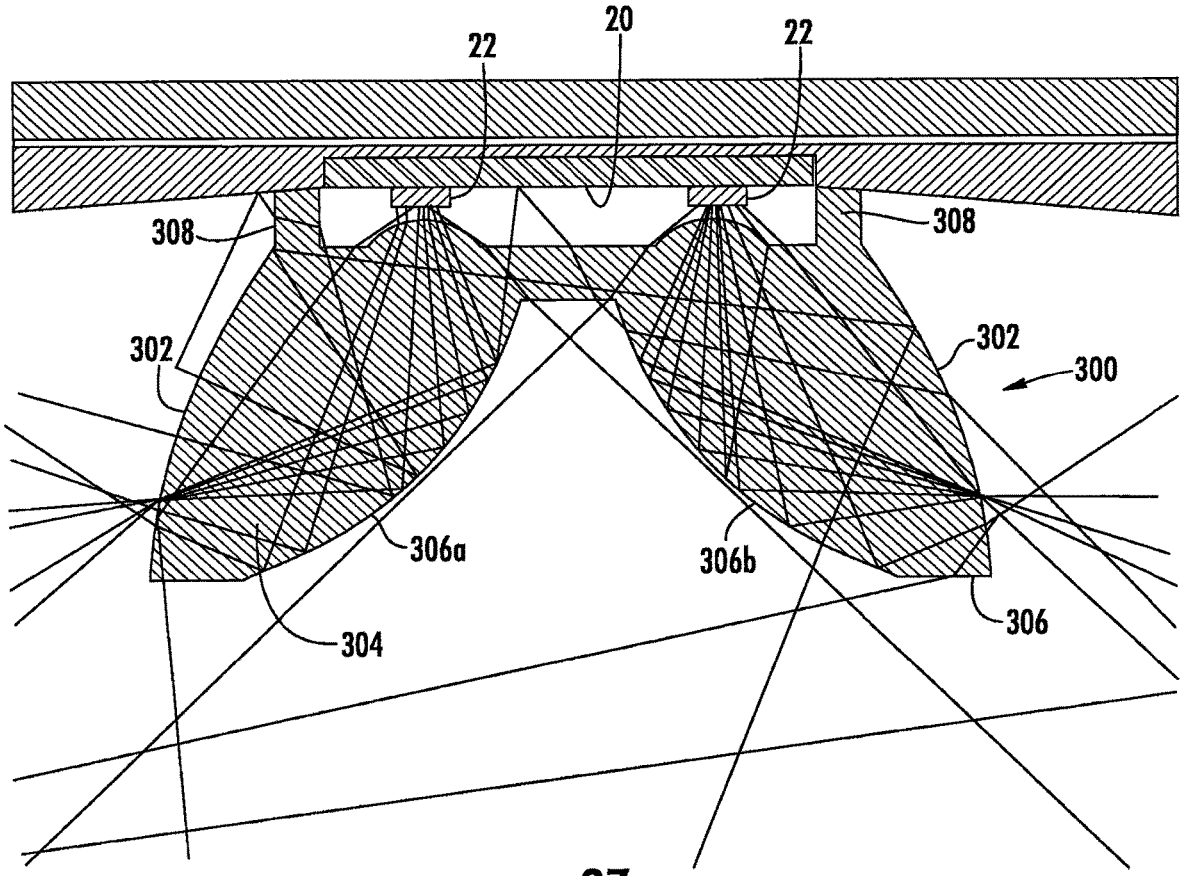
FIG. 27 is a detail view showing a light emitting pattern of the LED assembly and reflector assembly of FIG. 22.
Figure 28:
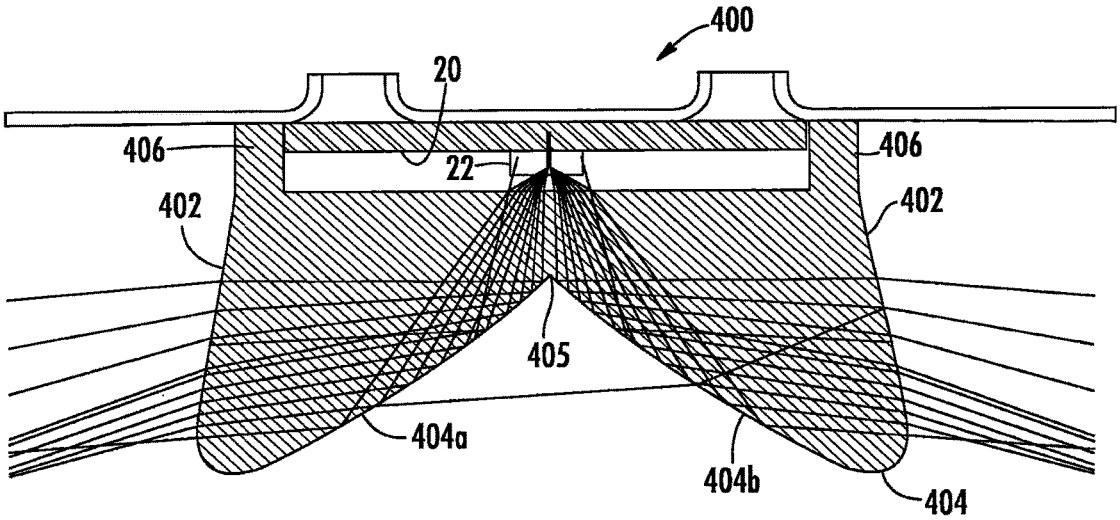
FIG. 28 is a detail view showing a light emitting pattern of the LED assembly and reflector assembly of FIG. 25.
Figure 29:
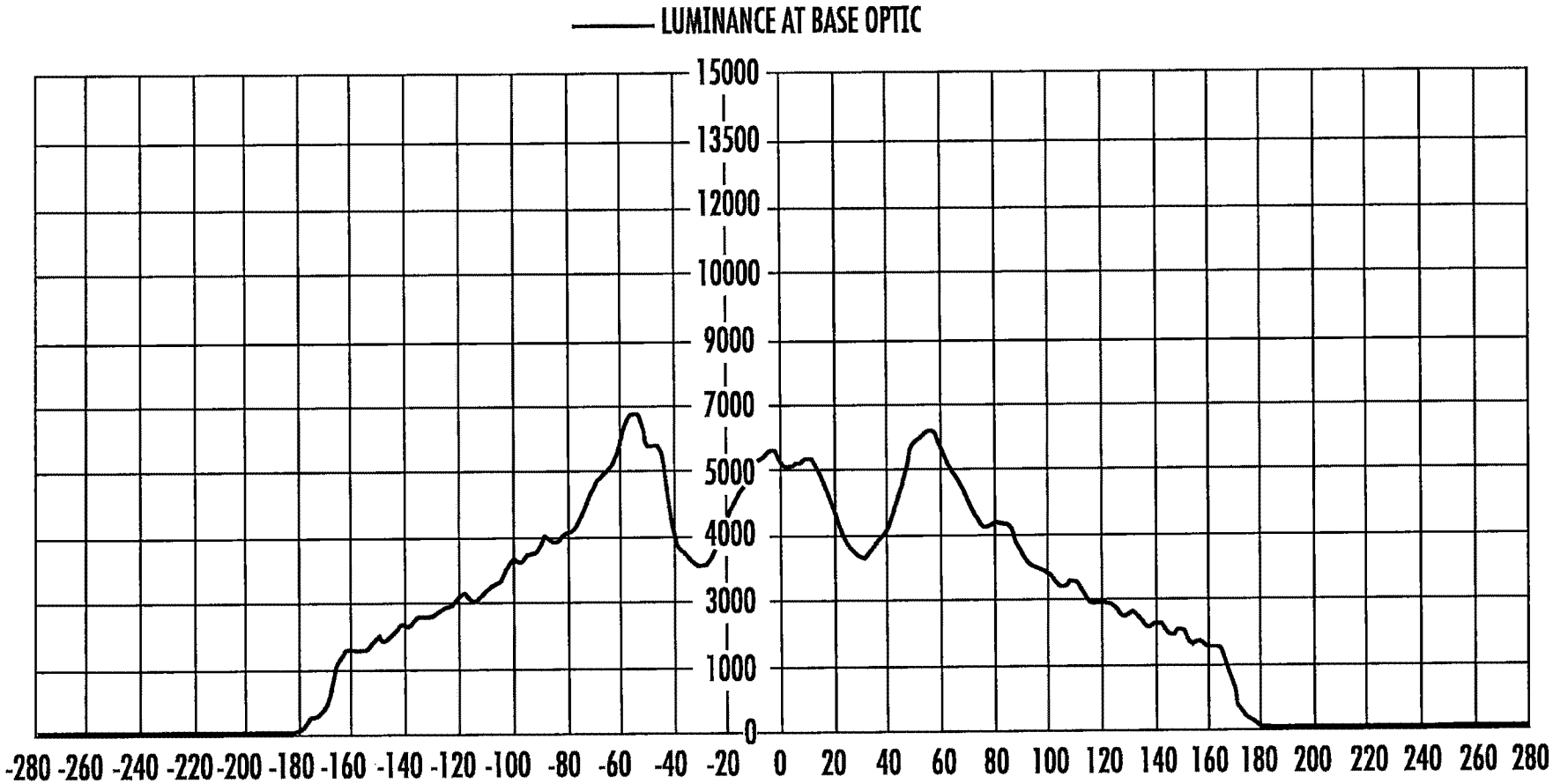
FIG. 29 is a luminance diagram of the lighting fixture using the assembly of FIG. 22.
Figure 30:
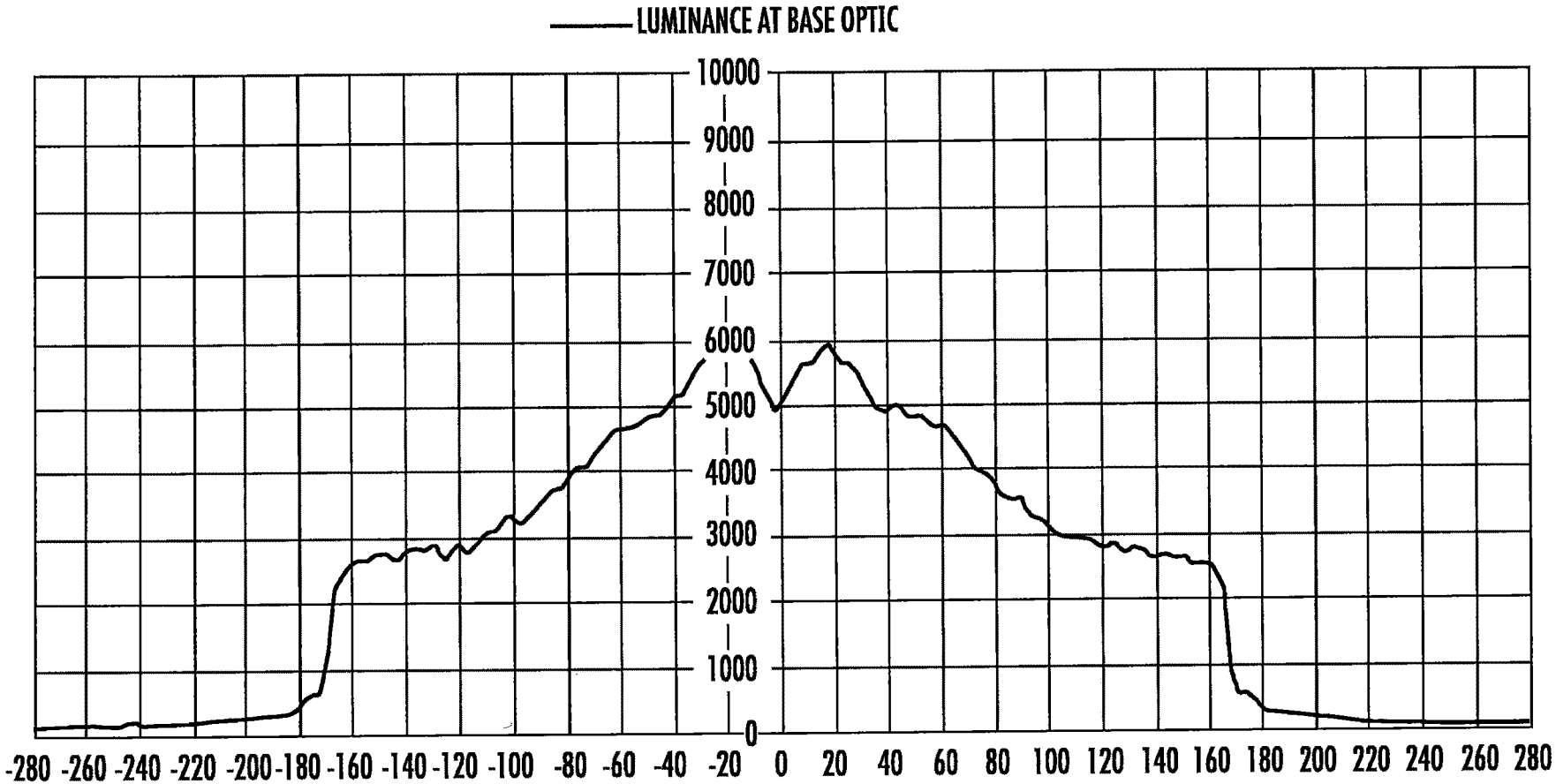
FIG. 30 is a luminance diagram of the lighting fixture using the assembly of FIG. 25.

FIG. 27 shows the light emission pattern for the TIR reflector assembly used with two linear arrays of LEDs. FIG. 28 shows the light emission pattern for the TIR reflector assembly used with a single linear array of LEDs. FIG. 29 shows the luminance pattern for the TIR optic used with two linear arrays of LEDs. FIG. 30 shows the luminance pattern for the TIR optic used with a single linear arrays of LEDs.

Figure 32:
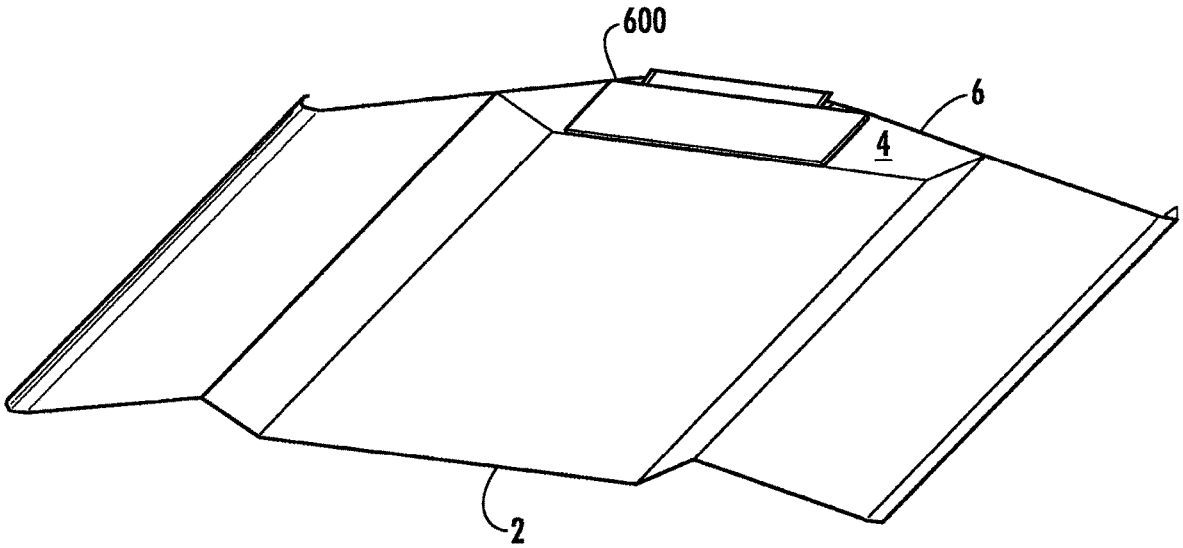
FIG. 32 is a partial section view showing an alternate embodiment of the LED assembly in a troffer-style lighting fixture.
Figure 33:
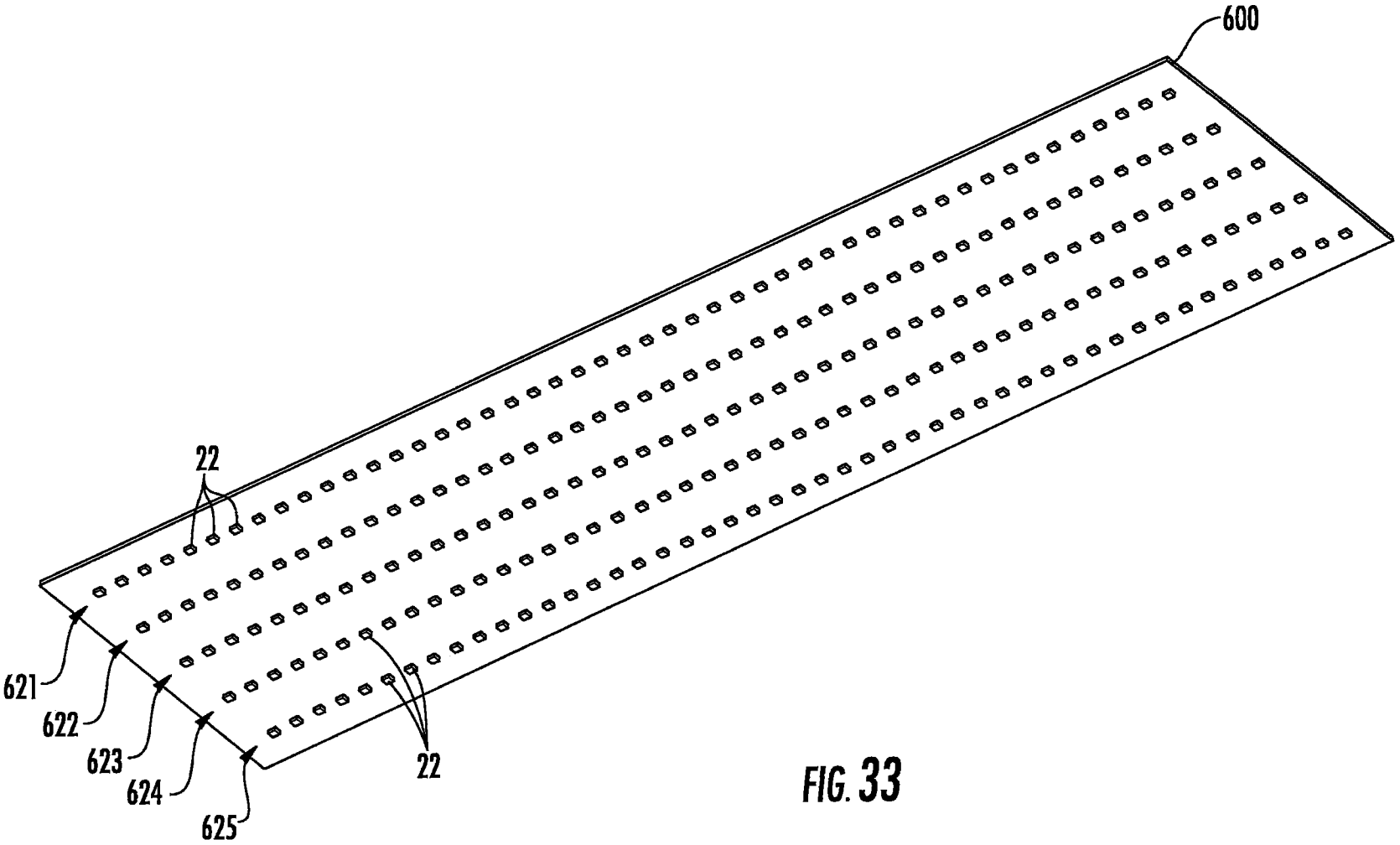
FIG. 33 is a perspective view of one embodiment of a LED board usable in the lighting fixture of FIG. 32.
Figure 35:
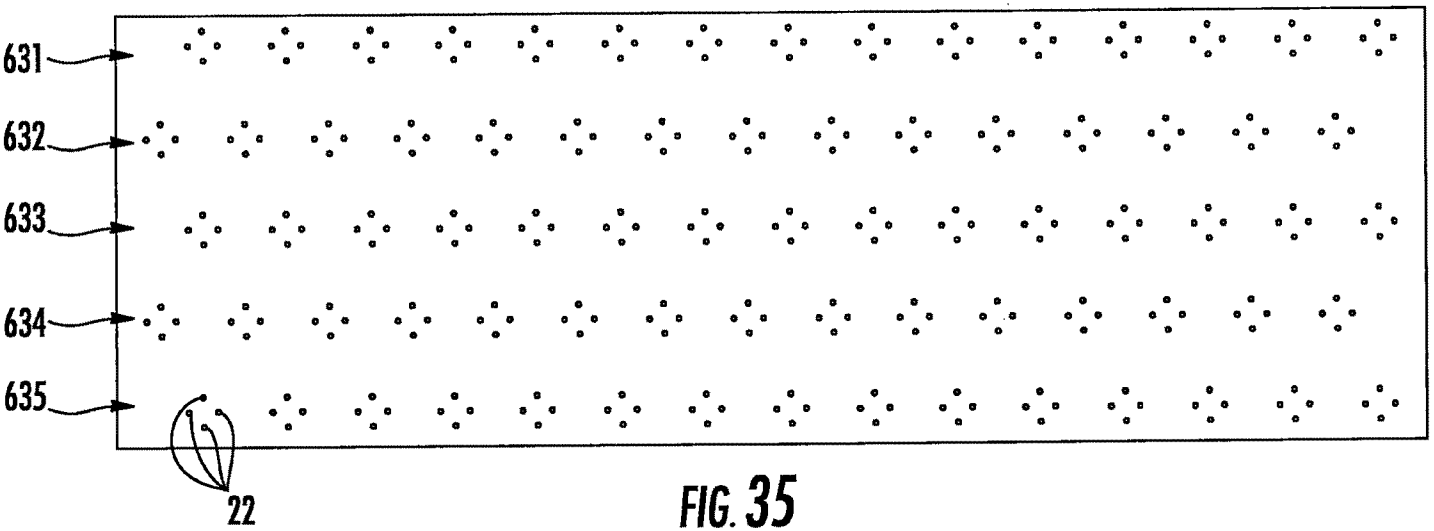
FIG. 35 is a perspective view of another embodiment of a LED board usable in the lighting fixture of FIG. 32.
Figure 36:
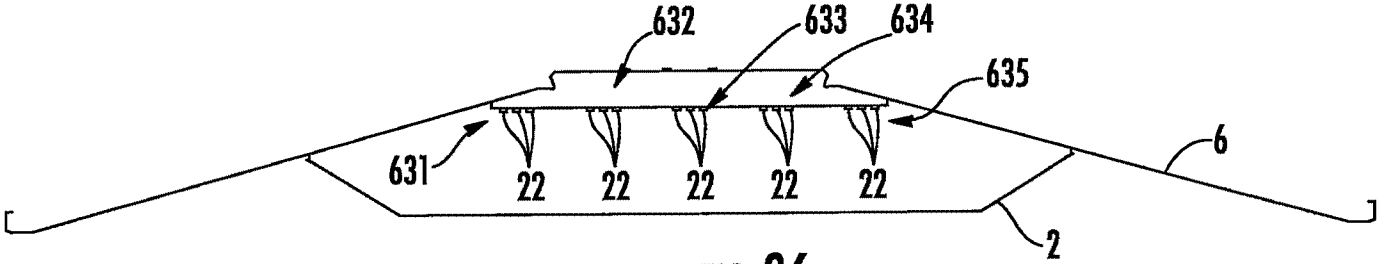
FIG. 36 is a section view of the lighting fixture of FIG. 32 with the LED board of FIG. 35.
Figure 34:
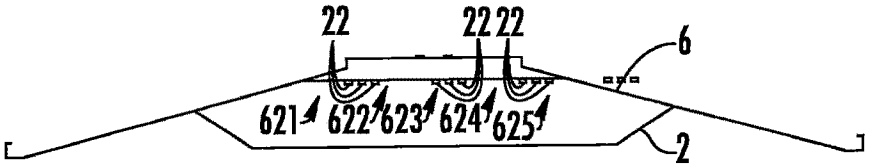
FIG. 34 is a section view of the lighting fixture of FIG. 32 with the LED board of FIG. 33.
Figure 37:
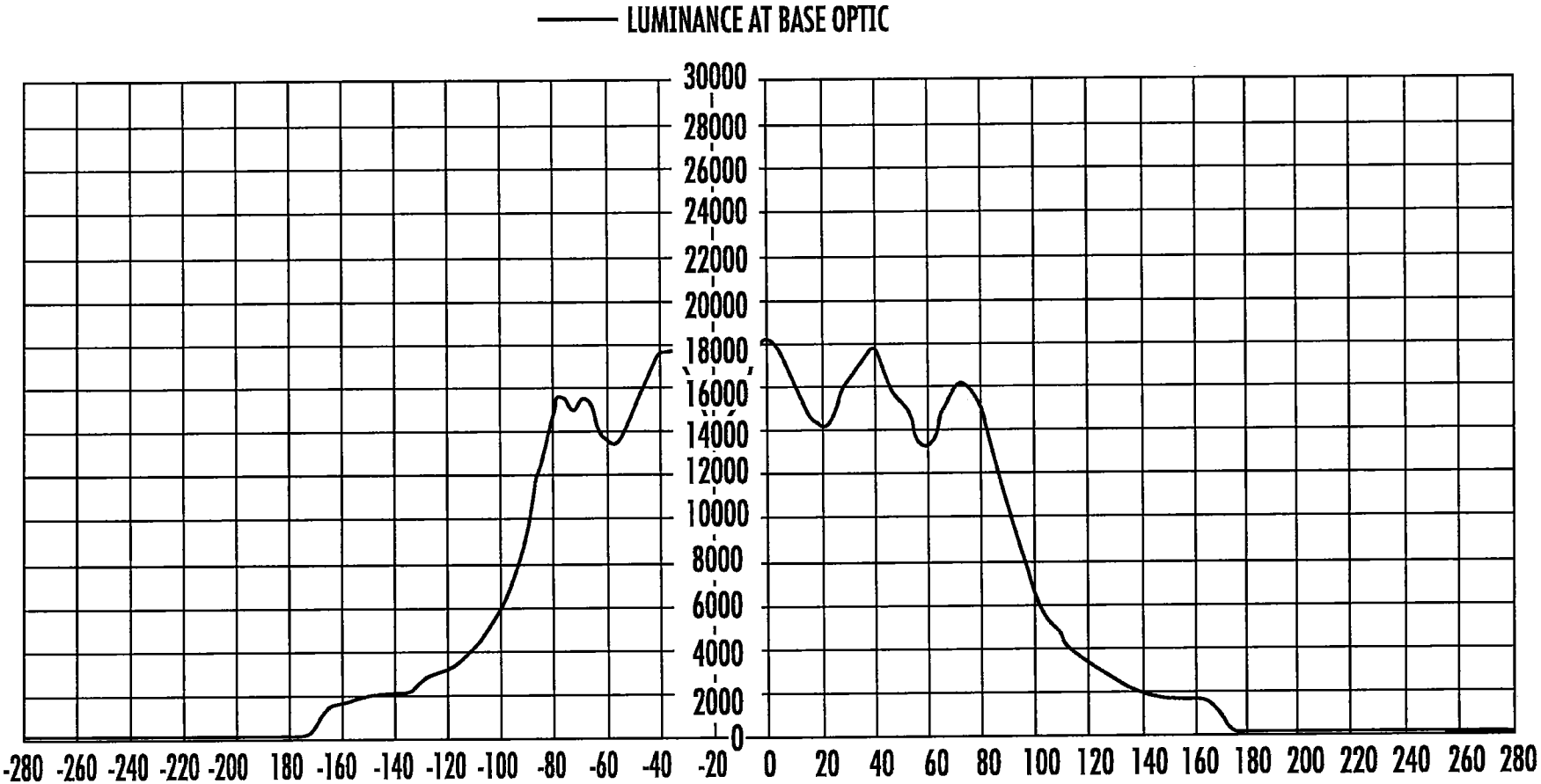
FIG. 37 is a luminance diagram of the lighting fixture of FIG. 32.

Other embodiments of the troffer-style fixture with a wide lens are shown in FIGS. 32-36. FIG. 32 shows a schematic partial section perspective view of a troffer-style light fixture having a housing 6, defining a diffusive troffer pan. A wide-fixture lens 2 is mounted in the housing as previously described. A LED board 600 supporting a plurality of LEDs 22 is mounted in the space 4 inside of lens 2 and emit light when powered through an electrical path as previously described. In the embodiment of FIGS. 32-36 the LED board is a wide LED board as compared to the LED boards of the preceding embodiments and the LED board supports a wide array of LEDs. In these embodiments the LED board is approximately 7 inches wide for a lens having a width W of approximately 13-14 inches. The width of the LED board is approximately 45-55% of the width of the lens and, in one embodiments the width of the LED board is approximately 50% of the width of the lens, with the LEDs spaced approximately evenly over the surface of the LED board. Referring to FIGS. 33 and 34, in one embodiment the LEDs 22 are disposed in a plurality of relatively evenly spaced linear arrays or rows 621, 622, 623, 624 and 625 where each row extends for approximately the length of the lens. The LEDs 22 in each row may be arranged in an alternating pattern as previously described. For a lens as described above five rows of LEDs are used although this number may be increased or decreased based on the total luminance of the light fixture and the width of the 2 lens. Referring to FIGS. 35 and 36, in another embodiment the LEDs 22 are disposed in spaced linear arrays or rows 631, 632, 633, 634 and 635 where each row extends for approximately the length of the lens. The rows of LEDs comprise LED clusters where each cluster comprises four closely spaced LEDs where the clusters are spaced approximately 0.5 inches from the adjacent clusters. The LED assembly 8 may include clusters of discrete LEDs, with each LED within the cluster spaced a distance from the next LED, and each cluster spaced a distance from the next cluster. Each cluster has four LEDs and each LED is located at each corner of a square pattern. The four LEDs are arranged by a combination of BSY1, BSY2 and two BSRs, where BSY1 & BSY2 are located in line and the two BSRs are orthogonally located to the line of BSY1 & BSY2. Some embodiments may use a series of clusters having blue-shifted-yellow LEDs ("BSY") and red LEDs ("R"). Once properly mixed the resultant output light will have a "warm white" appearance. In other embodiments separate blue-shifted-yellow LEDs and a green LED and/or blue-shifted-red LEDs and a green LED may be used. In some embodiments five rows of clusters may be used where each row has 15 clusters and each cluster has 4 LEDs for a total of 300 LEDs. In other embodiments, five rows of clusters may be used where each row has 14 clusters and each cluster has 4 LEDs for a total of 280 LEDs. With a wide LED board array no internal reflector is required because the wide array of LEDs provides sufficient lateral spreading of the light across the lens. FIG. 37 shows the luminance pattern for a wide LED board array.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A troffer light fixture, comprising:

a housing;

a LED assembly positioned in the housing, the LED assembly comprising a first linear LED array comprising a plurality of first LEDs and a second linear LED array comprising a plurality of second LEDs;

a lens covering the first linear LED array and the second linear LED array; and a reflector assembly extending between the first linear LED array and the second linear LED array, the reflector assembly comprising a first reflective surface reflecting light from the first linear LED array and a second reflective surface reflecting light from the second linear LED array.

2. The troffer light fixture of claim 1 wherein the LED assembly comprises a LED board supporting the first linear LED array and the second linear LED array, the LED board being in an electrical path to the plurality of LEDs.

3. The troffer light fixture of claim 1 wherein the lens has a width of at least approximately 250 mm.

4. The troffer light fixture of claim 3 wherein the lens has a width of approximately 250 mm to 375 mm.

5. The troffer light fixture of claim 3 wherein the lens is diffusive.

6. The light fixture of claim 5 wherein the first reflective surface is configured to reflect the light emitted by the first LED array laterally in a first direction and the second reflective surface is configured to reflect the light emitted by the second LED array laterally in a second direction.

7. The light fixture of claim 1 wherein the first linear LED array and the second linear LED array each comprise at least two differently colored LEDs.

8. The light fixture of claim 7 wherein the first linear LED array and the second linear LED array each comprise three different colored LEDs ordered BSY1, BSR, BSY2, BSR, BSY1, BSR, BSY2 for the length of the array.

9. The light fixture of claim 8 wherein each LED in the plurality of first LEDs in the first LED array are spaced from an adjacent LED in the plurality of first LEDs by less than or equal to approximately 12 mm.

10. The light fixture of claim 1 wherein the first reflective surface and the second reflective surface have a parabolic shape.

11. The light fixture of claim 1 wherein the first reflective surface and the second reflective surface have a splined shape.

12. The light fixture of claim 1 wherein the first reflective surface and the second reflective surface reflect approximately 65-75% of the light emitted by the first LED array and the second LED array.

13. The light fixture of claim 1 wherein the first reflective surface and the second reflective surface are symmetrical.

14. The troffer light fixture of claim 1 wherein a surface of the housing is diffusive and reflects at least a portion of the light emitted by the LED assembly.

15. The light fixture of claim 1 wherein the first reflective surface and the second reflective surface are asymmetrical.

16. The light fixture of claim 1 wherein the first reflective surface and the second reflective surface have specular reflective properties.

17. The light fixture of claim 1 further comprising a third LED array comprising a plurality of third LEDs, the third LED array being disposed between the first LED array and the second LED array.

18. The light fixture of claim 17 wherein the light emitted by the third LED array is not reflected before being received by the lens.

19. The light fixture of claim 18 wherein the third LED array produces lower lumen output than the first linear LED array and the second linear LED array.

20. A troffer light fixture, comprising:

a housing;

a first linear LED array comprising a plurality of first LEDs and a second linear LED array comprising a plurality of second LEDs;

a lens covering the first linear LED array and the second linear LED array; and a reflector assembly extending along the first linear LED array and the second linear LED array positioned to receive light from the first linear LED array and the second linear LED array, the reflector assembly comprising a TIR reflector comprising a first reflective surface reflecting light from the first linear LED array in a first lateral direction and a second reflective surface reflecting light from the and the second linear LED array in a second lateral direction.

* * * * *